US010286540B2

(12) United States Patent
Barry

(10) Patent No.: US 10,286,540 B2
(45) **Date of Patent: *May 14, 2019**

(54) MODULAR INTERLOCKING CONTAINERS AND SYSTEMS THEREOF

(71) Applicant: Robert Barry, Reston, VA (US)

(72) Inventor: Robert Barry, Reston, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/626,011

(22) Filed: Jun. 16, 2017

(65) Prior Publication Data

US 2017/0348848 A1 Dec. 7, 2017

Related U.S. Application Data

(63) Continuation of application No. 15/051,637, filed on Feb. 23, 2016, now Pat. No. 9,724,819.

(60) Provisional application No. 62/119,706, filed on Feb. 23, 2015.

(51) Int. Cl.
*B25H 3/00* (2006.01)

(52) U.S. Cl.
CPC ..... *B25H 3/006* (2013.01)

(58) Field of Classification Search
CPC .... B65D 21/0202; B65D 25/10; B65D 25/28; B65D 2525/283; B25H 3/006; A45F 3/04; A45F 3/14; A45F 5/00; B62B 2202/12; B62B 2202/20; B62B 2202/24; B62B 2202/48; B62B 2202/50; B62B 2202/61; B62B 2202/64
USPC ... 220/23.4, 23.83, 244, 250, 323, 553, 833; 292/162; 414/444–457
See application file for complete search history.

(56) References Cited

U.S. PATENT DOCUMENTS

| | | | | |
|---|---|---|---|---|
| 2,776,792 A | | 1/1957 | Pearson | |
| 3,307,729 A | * | 3/1967 | Schwartz | B65D 21/0202 206/504 |
| 3,338,452 A | * | 8/1967 | Oakley | H01M 2/0245 220/23.4 |
| 3,599,828 A | | 8/1971 | Conway | |
| 3,749,273 A | * | 7/1973 | Wreghitt | B65D 90/0006 206/504 |
| 4,133,445 A | * | 1/1979 | Mandelbaum | B65D 21/0204 206/504 |

(Continued)

*Primary Examiner* — Chun Hoi Cheung
*Assistant Examiner* — Brijesh V. Patel
(74) *Attorney, Agent, or Firm* — Symbus Law Group, LLC; Clifford D. Hyra

(57) ABSTRACT

A container, e.g., a carry-case, includes: a body having an internal cavity for storing contents, the body including at least one access side of the body having at least one opening sufficient in size to accommodate movement of the contents through the opening(s); and at least one lid configured to releasably close the at least one opening, respectively. The body further includes: first and second stacking sides in which are formed complimentarily-shaped surface feature(s) and surface feature(s), respectively, configured to be releasably engageable with the corresponding surface feature(s) formed in second and first stacking sides, respectively, of other instances of the container. And each access side and corresponding lid are configured to permit access through the corresponding opening while one or more of the first and second stacking sides are disposed in states of releasable engagement, respectively.

10 Claims, 38 Drawing Sheets

(56) References Cited

U.S. PATENT DOCUMENTS 4,328,902 A * 5/1982 North ..... B65D 21/0204 220/23.4
4,487,347 A 12/1984 Zegar
4,656,840 A * 4/1987 Loofbourrow ..... F25D 3/08 215/10
4,743,038 A 5/1988 Myers
4,883,251 A * 11/1989 Manas ..... F25C 1/24 206/509
4,889,254 A * 12/1989 Vola ..... A45C 7/0045 132/294
5,050,755 A * 9/1991 Strawder ..... B65D 21/0202 220/23.4
5,381,916 A 1/1995 Strawder
5,628,443 A * 5/1997 Deutsch ..... A45C 7/0086 150/113
5,868,246 A 2/1999 Westfall
5,890,595 A * 4/1999 Credle, Jr. ..... A63H 33/086 206/501
6,131,926 A 10/2000 Harlan
6,254,112 B1 7/2001 Clegg
6,360,884 B1 3/2002 Smith
7,011,214 B2 * 3/2006 Brackmann ..... B60P 3/03 206/509
7,159,712 B1 1/2007 Chen
7,416,160 B2 8/2008 Cies
7,780,026 B1 8/2010 Zuckerman
8,046,961 B1 11/2011 Cutting
8,668,209 B1 3/2014 Anzivino
2005/0092650 A1 5/2005 Romero
2005/0199459 A1 * 9/2005 Harvey ..... A45C 5/14 190/108
2008/0264820 A1 * 10/2008 Becklin ..... B65D 21/0223 206/508
2010/0170897 A1 7/2010 Gold
2012/0006837 A1 1/2012 Becklin
2012/0211492 A1 * 8/2012 Kelly ..... B65D 5/302 220/265
2012/0228074 A1 * 9/2012 Osler ..... A45C 5/14 190/18 A
2013/0213927 A1 * 8/2013 Hendrickson ..... B65D 23/00 215/383
2014/0103035 A1 * 4/2014 Fredette ..... B65D 19/02 220/6

* cited by examiner

MODULAR INTERLOCKING CONTAINERS AND SYSTEMS THEREOF

This application is a continuation of U.S. nonprovisional patent application Ser. No. 15/051,637, filed Feb. 23, 2016, which claims the benefit of U.S. Provisional Application No. 62/119,706, filed Feb. 23, 2015, each of which is hereby incorporated by reference in its entirety.

FIELD OF THE DISCLOSURE

Embodiments of the present invention relate to containers used to convey contents, and more particularly to such containers that are modular, and to interlocking assembly of such to form one or more container-assemblies.

BACKGROUND

There are a wide variety of containers designed to carry within them contents that are either a) held loosely within the container or b) held securely within a shaped interior preventing contents' movement within the container. An example of the former is a common, rectangular-cuboid shaped metal or plastic box with hinged lid, lid-locking latch, and carrying handle. An example of the latter is a hinged plastic-molded carrying case with integrated handle that is commonly used as packaging when purchasing a powered hand-tool such as a power drill.

In the context of powered hand-tools, for example, during a single period of work, it is common that a person will require use of multiple such tools. In those scenarios, multiple powered hand-tools must be conveyed to the worksite by some method. One known method for conveying multiple powered hand-tools to a worksite is to dispose each tool in its own container and then separately transport the individual containers. Another known method is to dispose each tool in its own container, then arrange the containers into a container-assembly, transport the container-assembly to the worksite, and then disassemble the container-assembly in order to gain access to the tools while at the worksite.

Irrespective of whether the objects of the transportation, i.e., the powered hand-tools which are disposed within the corresponding containers, are arranged as a collection of loose containers or as a multi-container-assembly, it is common to convey the objects at least part of the way to the worksite on a hand-truck.

SUMMARY

It is to be understood that both the following summary and the detailed description are exemplary and explanatory and are intended to provide further explanation of the present invention as claimed. Neither the summary nor the description that follows is intended to define or limit the scope of the present invention to the particular features mentioned in the summary or in the description. Rather, the scope of the present invention is defined by the appended claims.

In certain embodiments, the disclosed embodiments may include one or more of the features described herein.

An aspect of the present invention provides a container comprising: a body (which may be e.g. parallelepiped-shaped) having an internal cavity for storing contents, the body including at least one access side of the body having at least one opening therein sufficient in size to accommodate movement of the contents therethrough; and at least one lid configured to releasably close the at least one opening, respectively. The body further includes: first and second stacking sides having formed therein complementarily-shaped (for example convex and concave) surface features, respectively, configured to be releasably engageable with the corresponding surface features formed in second and first stacking sides, respectively, of other instances of the container. Each access side and corresponding lid are configured to permit access therethrough while one or more of the first and second stacking sides are disposed in states of releasable engagement, respectively. The surface features of the first stacking side and the surface features of the second stacking side may include one or more mesas and one or more corresponding recesses, respectively. The surface features of the first stacking side and the surface features of the second stacking side may include one or more posts and one or more corresponding apertures, respectively. The apertures in the second stacking side may be configured as keyhole slots having a major diameter and a minor diameter and the posts may be cylindrical, each post having a diameter corresponding to the major diameter of the keyhole slot and including an annular recess such that the diameter of the post in the annular recess is correspondingly reduced to the minor diameter of the keyhole slot. A handle may be attached to the body and may be attached to the body via one of the at least one lids. The body may include a cabling side having a side that includes a first electrical female connector and the internal cavity may be provided with a second electrical female connector electrically connected to the first female connector. The container may be one of a carry-case and a transit-case.

The complimentary shaped surface features of the first stacking side may include a plurality of sets of coaxial sleeves and the complimentary shaped surface features of the second stacking side may also include a plurality of sets of coaxial sleeves, where each of the plurality of sets of coaxial sleeves on the second stacking side is capable of intermeshing with a corresponding one of the plurality of sets of coaxial sleeves of the other instances of the container so as to form a plurality of coaxial whole sets of intermeshed coaxial sleeves. The container may also include a plurality of removable rods, each of the plurality of removable rods being capable of sliding through a one of the plurality of coaxial whole sets of intermeshed coaxial sleeves. The container may also include a plurality of snap-locks in a third side of the body, each of the plurality of snap-locks receiving an end of a respective one of the plurality of removable rods while each of the plurality of removable rods is positioned through and within respective ones of the plurality of sets of coaxial sleeves, and each of the plurality of snap locks receiving an end of a respective one of the plurality of removable rods while each of the plurality of removable rods is positioned through and within respective ones of the plurality of sets of coaxial whole sets of intermeshed coaxial sleeves.

The complimentary shaped surface features of the first stacking side may include a plurality of sets of loops, the complimentary shaped surface features of the second stacking side may include a plurality of latches capable of receiving and releasably engaging a first set of the plurality of sets of loops of the other instances of the container, and the complimentary shaped surface features of the second stacking side may include a plurality of hooks capable of receiving and releasably engaging a second set of the plurality of sets of loops of the other instances of the container.

The complimentary shaped surface features of the first stacking side may include a plurality of sets of T tabs, each T tab having a receiver cutout, the complimentary shaped surface features of the second stacking side may include a plurality of sets of pairs of L tabs, a one of each of the pairs of L tabs including a sliding and locking mechanism, each set of pairs of L tabs being capable of receiving and releasably engaging a one of the plurality of sets of T tabs of the other instances of the container, and each receiver cutout capable of receiving and releasably engaging a corresponding sliding and locking mechanism of the other instances of the container when the T tab having that receiver cutout is engaged with the L tab of the other instances of the container.

The complimentary shaped surface features of the first stacking side may include a first plurality of latches, a first plurality of loops, and a first plurality of body tabs, the complimentary shaped surface features of the second stacking side may include a second plurality of latches, a second plurality of loops, and a second plurality of body tabs, each of the first plurality of body tabs may be capable of receiving and releasably engaging a corresponding one of the first plurality of loops of the other instances of the container, each of the second plurality of body tabs may be capable of receiving and releasably engaging a corresponding one of the second plurality of loops of the other instances of the container, each of the first plurality of latches may be capable of latching a corresponding pair of engaged ones of the first plurality body tabs and the first plurality of loops of the other instances of the container, and each of the second plurality of latches may be capable of latching a corresponding pair of engaged ones of the second plurality body tabs and the second plurality of loops of the other instances of the container.

The complementarily-shaped surface features, respectively, configured to be releasably engageable with the corresponding surface features may include a plurality of different types of complimentarily-shaped surface features and corresponding surface features, such as those described with reference to various embodiments above. A first type of the plurality of different types of complimentary-shaped surface features and corresponding surface features may have a dimension in a depth direction and a dimension in a width direction, and the dimension in the depth direction of the first type of the plurality of types of complimentary-shaped surface features and corresponding surface features may be larger than the dimension in the width direction of the first type of the plurality of types of complimentary-shaped surface features and corresponding surface features, and a second type of the plurality of different types of complimentary-shaped surface features and corresponding surface features may have a dimension in the depth direction and a dimension in the width direction, and the dimension in the depth direction of the second type of the plurality of types of complimentary-shaped surface features and corresponding surface features may be smaller than the dimension in the width direction of the second type of the plurality of types of complimentary-shaped surface features and corresponding surface features. The first type of the plurality of different types of complimentary-shaped surface features and corresponding surface features may be a complimentary post and corresponding aperture, and the second type of the plurality of different types of complimentary-shaped surface features and corresponding surface features may be a complimentary mesa and corresponding recess. The container may also include an upper rim stiffener and a lower rim stiffener, the upper rim stiffener stiffening an upper rim of the body, the lower rim stiffener stiffening a lower rim of the body, the complimentary posts extending from a first side of the upper rim stiffener and from a first side of the lower rim stiffener, and a second side of the upper and lower rim stiffeners containing a portion of the apertures and a mechanism for achieving the releasable engagement of the corresponding complimentary posts of the other instances of the container.

In embodiments the container may include a removable insert, the removable insert being placed in the internal cavity, the removable insert defining at least one cutout cavity.

In embodiments, the container may include at least one accessory box, each of the at least one accessory boxes being within the internal cavity, each of the at least one accessory box having a door, the door being attached to the body and releasably engaged with the body so as to access an interior of the accessory box in a released position and secure the interior of the accessory box in an engaged position. The at least one accessory box may include a plurality of accessory boxes. The container may include a removable insert, the removable insert being placed in the internal cavity, the removable insert defining a first cutout cavity for receiving the at least one accessory box and at least one additional cutout cavity.

Another aspect of the present invention provides a container-assembly comprising: at least first and second containers, each container including: a body having an internal cavity for storing contents, the body including at least one access side of the body having at least one opening therein sufficient in size to accommodate movement of the contents therethrough; and at least one lid configured to releasably close the at least one opening, respectively. The body of each container further includes: first and second stacking sides having formed therein complementarily-shaped surface features, configured to be releasably engageable with the corresponding surface features formed in second and first stacking sides, respectively, of other instances of the container. For each container, each access side and corresponding lid are configured to permit access therethrough while one or more of the first and second stacking sides are disposed in states of releasable engagement, respectively. The container-assembly is assembled when surface features formed in the first and second stacking sides of the first container are releasably engaged with the corresponding surface features formed in second and first stacking sides of the second container, respectively.

The surface features of the first stacking side and the surface features of the second stacking side of each container may include one or more mesas and one or more corresponding recesses, respectively. The surface features of the first stacking side and the surface features of the second stacking side of each container may include one or more posts and one or more corresponding apertures, respectively. The apertures in the second stacking side of each container may be configured as keyhole slots having a major diameter and a minor diameter and the posts of each container may be cylindrical, each post having a diameter corresponding to the major diameter of the keyhole slot and each post including an annular recess such that the diameter of the post in the annular recess is correspondingly reduced to the minor diameter of the keyhole slot. The container assembly may also include a transport bar having apertures corresponding to the apertures on the second stacking sides of each of the containers where the bar is disposed in a sandwich arrangement between the first and second containers such that the posts on the first stacking side of one of the first and second containers pass through the apertures of the transport bar and are received in the apertures on the second stacking side of the other one of the first and second containers, respectively, the transport bar including attachment features to which a strap is mountable. Each container may also include a handle attached to the body. The handle of each container may be attached to the body via one of the at least one lids. The body of each container may also include a cabling side having a side that includes a first electrical female connector and the internal cavity may be provided with a second electrical female connector electrically connected to the first female connector. Each access side and corresponding lid may be configured to permit access therethrough while one or more of the first and second stacking sides of the containers are disposed in states of releasable engagement with the transport bar, respectively. Each of the first and second containers may be one of a carry-case and a transit-case.

The container-assembly may include a carrier apparatus and a first bar sandwiched between the at least first and second containers, the first bar being removable, the first bar having a plurality of locations of container connection, each of the plurality of locations of container connection being sandwiched between two of the at least first and second containers, and each of the plurality of locations of container connection being securely connected to each of two of the at least first and second containers, and a plurality of locations of carrier connection, the plurality of locations of carrier connection being different locations than the plurality of locations of container connection, the carrier apparatus being securely connected to the bar at one or more of the plurality of locations of carrier connection. The first bar may include a plurality of anchoring apertures, each of the plurality of anchoring apertures being at a one of the plurality of locations of container connection, and each of the plurality of anchoring apertures receiving a protrusion to achieve the secure connection to each of the two of the at least first and second containers. The at least first and second containers may include at least first, second and third containers, and further include a second bar, the second bar being removable, the second bar having a plurality of locations of container connection, each of the plurality of locations of container connection being sandwiched between the third container and another container of the at least first and second containers, and each of the plurality of locations of container connection being securely connected to each of the third container and the another container of the at least first and second containers, and a plurality of locations of carrier connection, the plurality of locations of carrier connection being different locations than the plurality of locations of container connection, the carrier apparatus being securely connected at one end thereof to the first bar at one or more of the plurality of locations of carrier connection on the first bar, and the carrier apparatus being securely connected at a second end thereof to the second bar at one or more of the plurality of locations of carrier connection on the second bar. The at least first and second containers may include at least first, second, third and fourth containers, a first one of the plurality of locations of container connection being sandwiched between the first and second containers, a second one of the plurality of locations of container connection being sandwiched between the third and fourth containers, the carrier apparatus being securely connected to the bar at two or more of the plurality of locations of carrier connection, a first of the two or more locations of carrier connection being closer to the first and second containers than to the third and fourth containers, a second of the two or more locations of carrier connection being closer to the third and fourth containers than to the first and second containers, and the carrier apparatus being connected to at least each of the first and second of the two or more locations of carrier connection.

Each of the at least first and second containers may also include a first power cord plug disposed in an opening in the body thereof, the power cord plug being connected to a power cord, the power cord having a length, and a first receptacle capable of engagement with an instance of the first power cord plug from an adjacent other of the at least first and second containers, the at least first and second containers being oriented such that all but one of the first receptacles are engaged with the instance of the first power cord plug from an adjacent other one of the at least first and second containers, such that each of the at least first and first and second containers are powered by the first power cord plug of a one of the at least first and second containers. Each of the at least first and second containers may also include a garage box, the garage box housing excess slack length of the power cord. Each of the at least first and second containers may also include a second receptacle capable of receiving a second power cord plug, the second receptacle being located in the internal cavity and being electrically connected to the first power cord plug. The container may also include a battery charger, the battery charger including the second power cord plug.

A further aspect of the present invention is to provide a hand-truck assembly comprising: a container-assembly (including first and second containers); a wheel assembly and a handle assembly. Each container includes: a body having an internal cavity for storing contents, the body including an access side of the body having an opening therein sufficient in size to accommodate movement of the contents therethrough; and a lid configured to releasably close the at least one opening. The body of each container further includes: first and second stacking sides having formed therein complementarily-shaped surface features including a plurality of posts and surface features including a plurality of apertures corresponding to the posts, respectively, configured to be releasably engageable with the corresponding surface features formed in second and first stacking sides, respectively, of other instances of the container. Wherein, for each container, each access side and corresponding lid are configured to permit access therethrough while one or more of the first and second stacking sides are disposed in states of releasable engagement, respectively. Wherein the surface features formed in the first stacking side of the first container are releasably engaged with the corresponding surface features formed in the first stacking side of the second container, respectively. The wheel assembly includes a first frame having apertures corresponding to the apertures on the second stacking sides of each of the containers. Wherein the apertures of the first frame are releasably engaged with the posts on the first stacking side of the first container, respectively. The handle assembly includes a second frame having posts corresponding to the apertures on the second stacking side of the second container. Wherein the posts of the second frame are releasably engaged with the apertures on the second stacking side of the second container, respectively. Each access side and corresponding lid may be configured to permit access therethrough while one or more of the first and second stacking sides of the containers is disposed in states of releasable engagement with handle and wheel assemblies, respectively.

These and further and other objects and features of the present invention are apparent in the disclosure, which includes the above and ongoing written specification, with the drawings.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art. Embodiments of the present invention will be more particularly described in conjunction with the following drawings wherein.

DRAWING LEADER DETAILS

Figure 1:
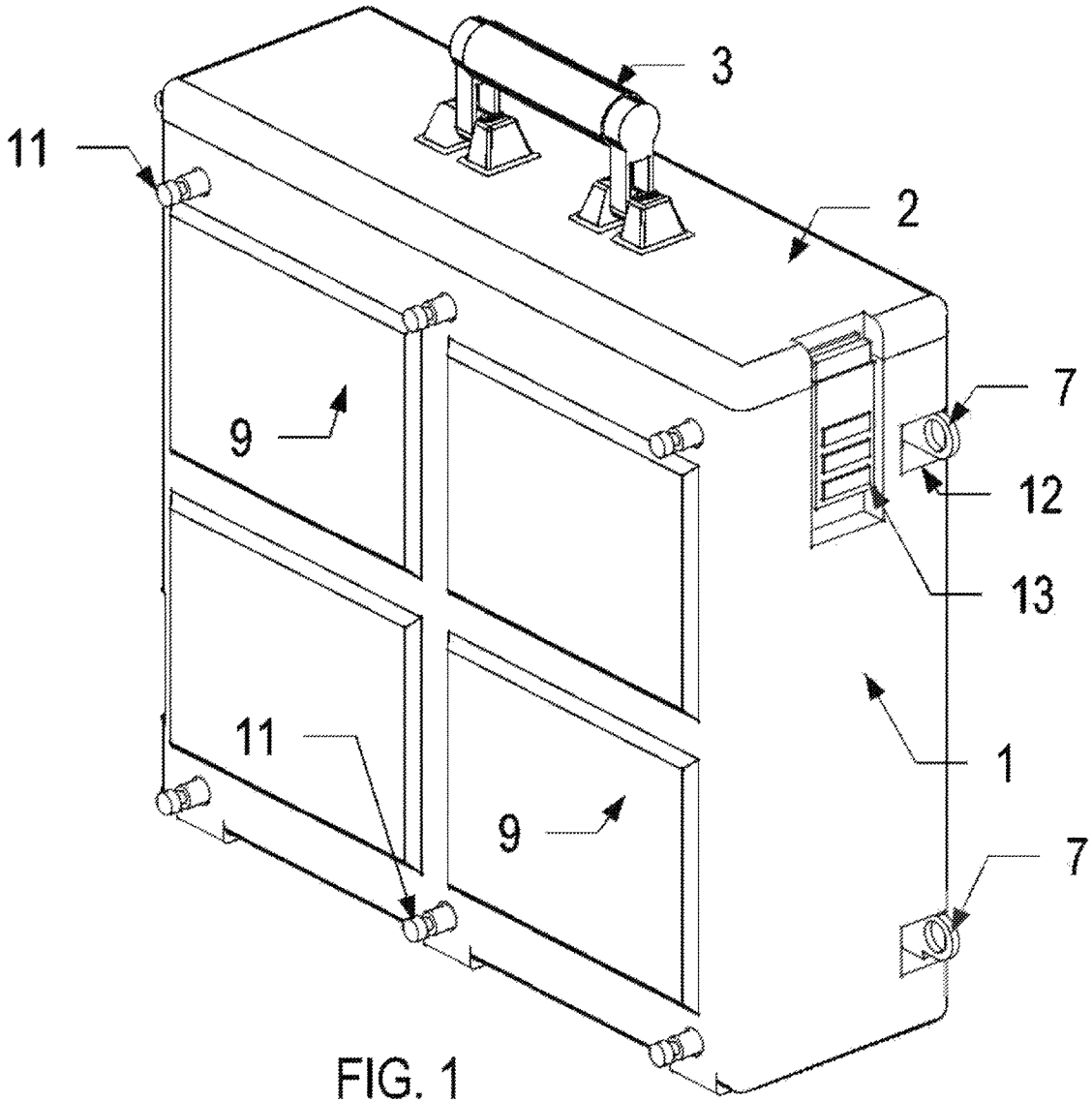
FIGS. 1-2 are left and right three-quarter perspective views, respectively, of a modular container according to an embodiment of the present invention.

1 Container Body
2 Container Lid
3 Container Carrying Handle
4 Container Lid Hinge
5 Container Body Opening—Power Cord
6 Container Body Opening—Attachment Point (Female)
7 Attachment Mechanism—Slider Lock
8 Container Body Recess
9 Container Body Protrusion
10 Container Body Opening—Power Supply Outlet
11 Attachment Mechanism—Male (Removable)
12 Container Body Opening—Slider Lock
13 Container Lid Closure Latch
14 Power Cord Origin
15 Power Supply Outlet—Exterior
16 Container Body Bottom
17 Power Cord
18 Upper Rim Stiffener
19 Lower Rim Stiffener
20 Power Supply Outlet—Interior
21 Power Junction Box
22 Power Cord Slack Storage
23 Attachment Mechanism—Slider Lock—Keyhole Receiver
24 Transport—Rolling—Handle
25 Transport—Rolling—Handle—Attachment Frame
26 Transport—Rolling—Handle—Attachment Point (Male)
27 Transport—Rolling—Wheels
28 Transport—Rolling—Wheels—Attachment Frame
29 Transport—Rolling—Wheels—Attachment Point (Female)
30 Transport—Rolling—Wheels—Attachment Mechanism—Slider Lock
31 Transport—Carry—Strap
32 Transport—Carry—Strap Bar—Single Length

34 Transport—Carry—Strap Bar—Passthrough for Male Attachment
35 Transport—Carry—Strap Bar—Double Length
40 Attachment Mechanism—sleeve and rod—Interbox-co-axial sleeve
41 Attachment Mechanism—sleeve and rod—removable rod
42 Attachment Mechanism—sleeve and rod—rod closed-position snap-lock
43 Attachment Mechanism—hook, loop, and latch—hook
44 Attachment Mechanism—hook, loop, and latch—loop
45 Attachment Mechanism—hook, loop, and latch—latch
46 Attachment Mechanism—sliding interlocks—"T" tab
47 Attachment Mechanism—sliding interlocks—"L" tab
48 Attachment Mechanism—sliding interlocks—lock slide
49 Attachment Mechanism—sliding interlocks—lock slide receiver cutout
50 Attachment Mechanism—horizontal latch—latch
51 Attachment Mechanism—horizontal latch—loop
52 Attachment Mechanism—horizontal latch—body tab
53 Box Insert
54 Tool Cutout
55 Cordless Drill
56 Box Insert Top Surface
57 Box Insert Front Surface
58 Accessory Storage Cutout
59 Open Interior Space Cutout
60 Battery Charger
61 Charger Power Cord
62 Accessory Storage Door Hinge
63 Accessory Storage Door Latch
64 Attachment Ring

DETAILED DESCRIPTION

Embodiments of containers used to convey contents, and more particularly to such containers that are modular, and interlocking assembly of such to form one or more container-assemblies, will now be disclosed in terms of various exemplary embodiments. This specification discloses one or more embodiments that incorporate features of the present invention. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. The skilled artisan will appreciate that a particular feature, structure, or characteristic described in connection with one embodiment is not necessarily limited to that embodiment but typically has relevance and applicability to one or more other embodiments.

In the several figures, like reference numerals may be used for like elements having like functions even in different drawings. The embodiments described, and their detailed construction and elements, are merely provided to assist in a comprehensive understanding of the present invention. Thus, it is apparent that the present invention can be carried out in a variety of ways, and does not require any of the specific features described herein. Also, well-known functions or constructions are not described in detail since they would obscure the present invention with unnecessary detail.

The description is not to be taken in a limiting sense, but is made merely for the purpose of illustrating the general principles of the present invention, since the scope of the present invention is best defined by the appended claims.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items. As used herein, the singular forms "a", "an" and "the" are intended to include the plural forms as well, unless the context clearly indicates otherwise.

The word "exemplary" is used herein to mean "serving as an example, instance, or illustration." Any embodiment described herein as "exemplary" is not necessarily to be construed as preferred or advantageous over other embodiments. Additionally, all embodiments described herein should be considered exemplary unless otherwise stated.

In developing embodiments of the present invention, among other things, the inventor thereof:

- recognized, during a single period of work, that it is common during the use of multiple powered hand-tools that the tools are used in a rotating succession—first using Tool A, then using Tool B, then using Tool A again, etc.;
- recognized, accordingly, that if each tool is readily available with minimal effort spent on extraction from its corresponding container, setup, etc., then progression through the rotation succession of tool use is facilitated;
- recognized that a person typically uses different combinations of tools during separate single instances of work periods, with a given combination being suited to the tasks to be performed during the corresponding work period; for example, when building an outdoor deck, a person may require a powered impact driver to secure framing bolts, a powered circular saw to cut deck and framing members, and a powered framing nailer to secure deck to framing members; however, when this same person is performing interior framing, the person may not need the powered impact driver but will instead need a powered screw gun.

One or more embodiments of the present invention provide containers used to convey contents (e.g., powered hand-tools), and more particularly to such containers that are modular, and container-assemblies (formed of interlocking two or more such containers), that facilitate making the tools available during, e.g., such a rotating succession of tool-use (as noted above) and/or that facilitate transport of different combinations of the tools (as noted above) to the worksite. In other words, in the context of the powered hand-tool examples discussed above, one or more embodiments of the present invention simplify the conveyance, passive organization, and ease of access to such tools. It should be understood, however, that the powered hand-tools discussed above are but one example of contents that are containable within containers that are modular and which permit interlock assembly thereof to form one or more container-assemblies, i.e., embodiments of the present invention are not limited to containing powered hand-tools.

Before discussing any of the FIGS. in detail, it is to be noted that each container is regarded as having a right side, a left side, a back side, a front side, a top side and a bottom side. Relative to the containers, it should be understood that the terms right side, left side, back side, front side, top side and bottom side do NOT denote orientation of the container on a given drawing page. As examples, in some of the figures: the 'back side and front' sides of the container might be illustrated as being located near the right edge and left edge of the drawing sheet, respectively; the 'left and right' sides of the container might be illustrated as being located near the right edge and left edge of the drawing sheet, respectively; etc.

Figure 2:
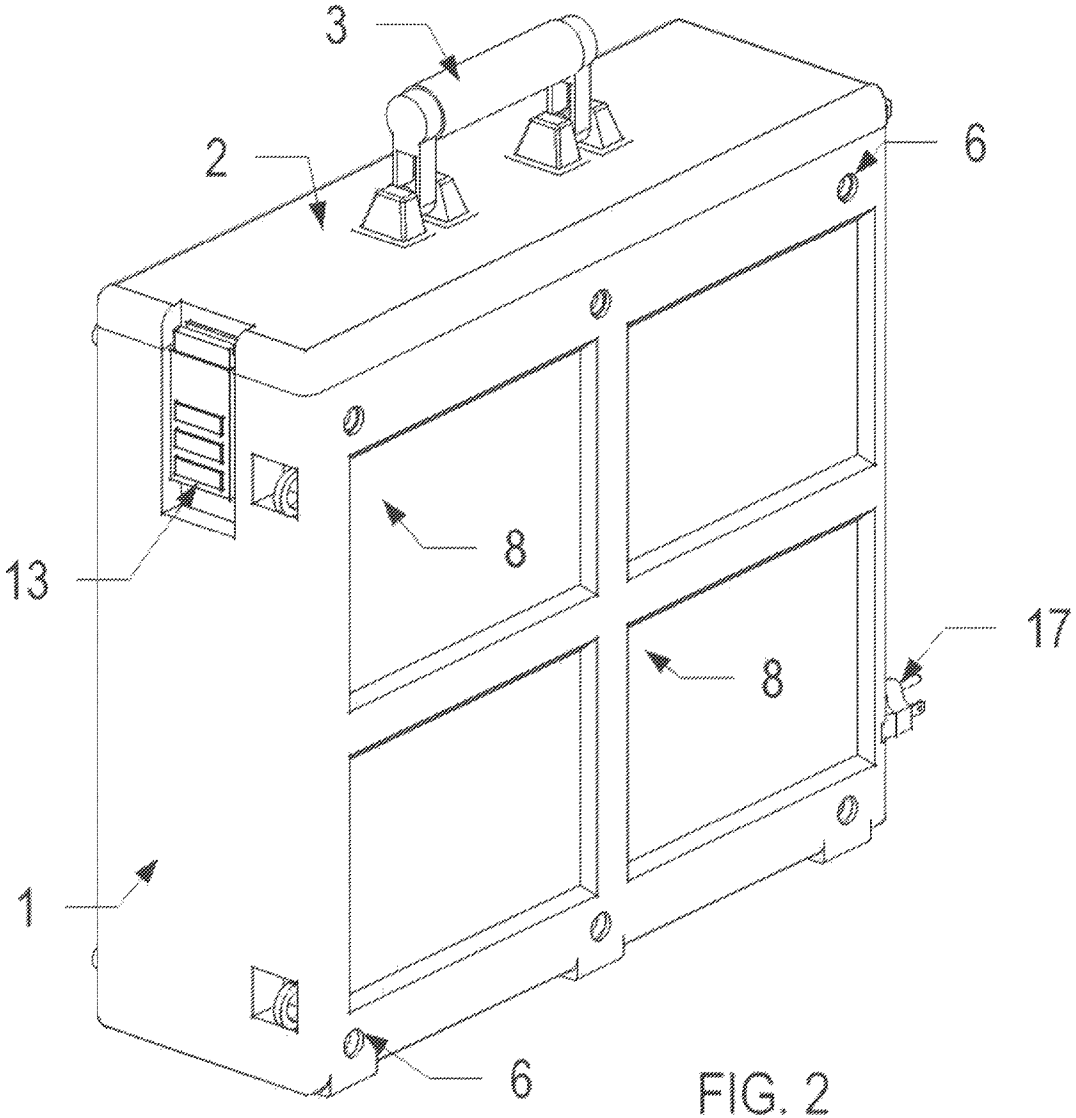
Figure 3:
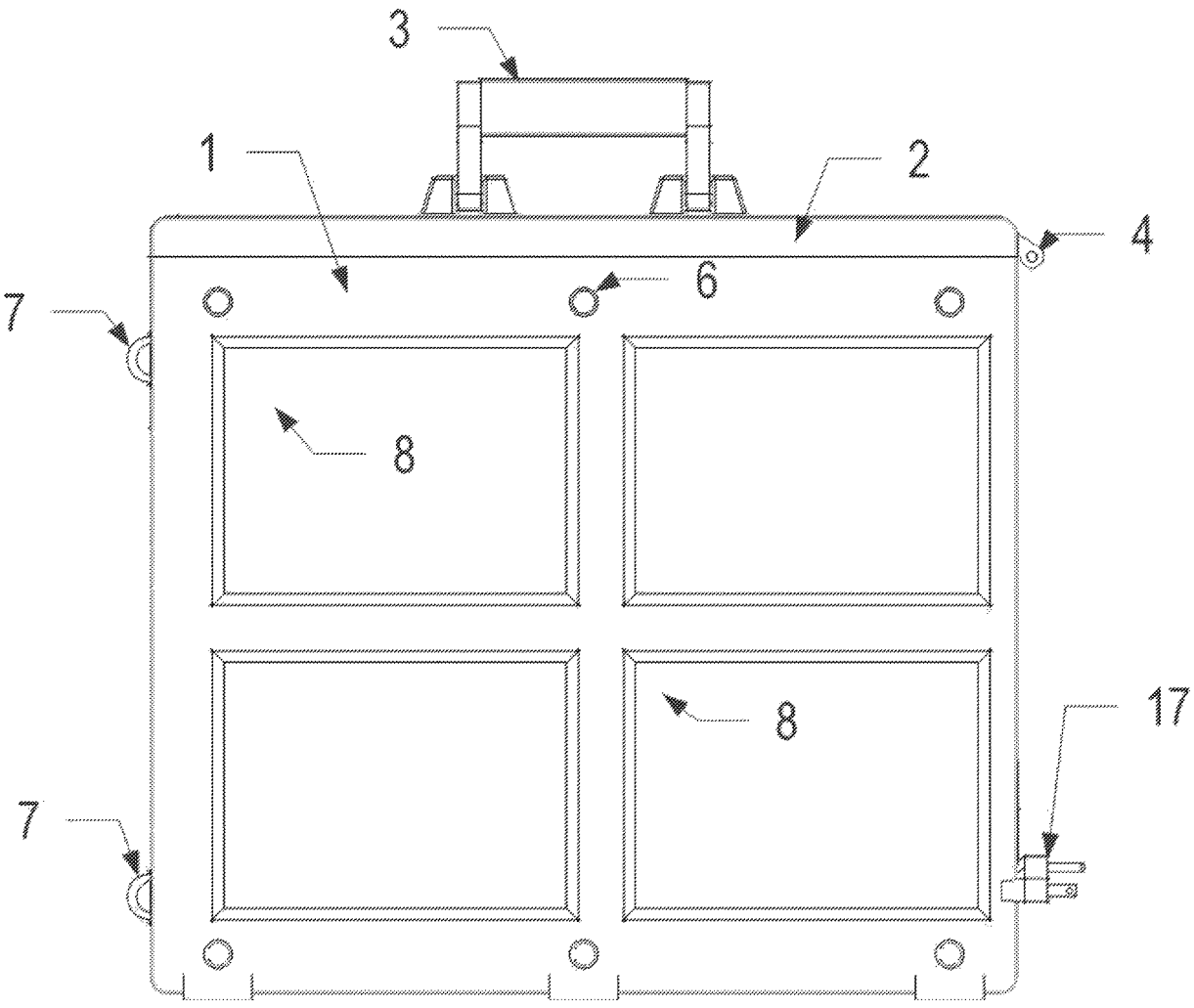
FIGS. 3-4 are right and left elevation views, respectively, of the modular container according to the embodiment of FIGS. 1-2.
Figure 4:
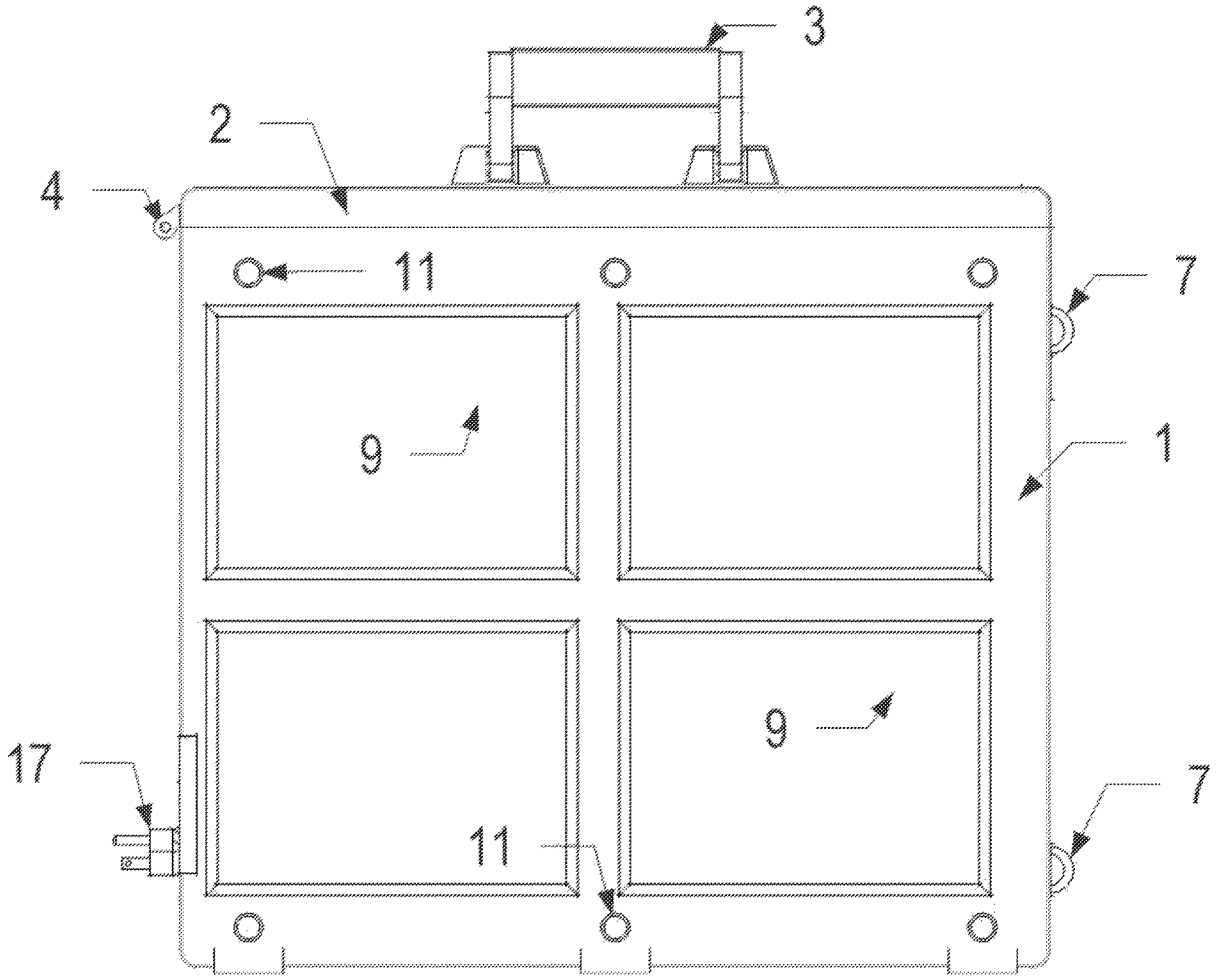
Figure 5:
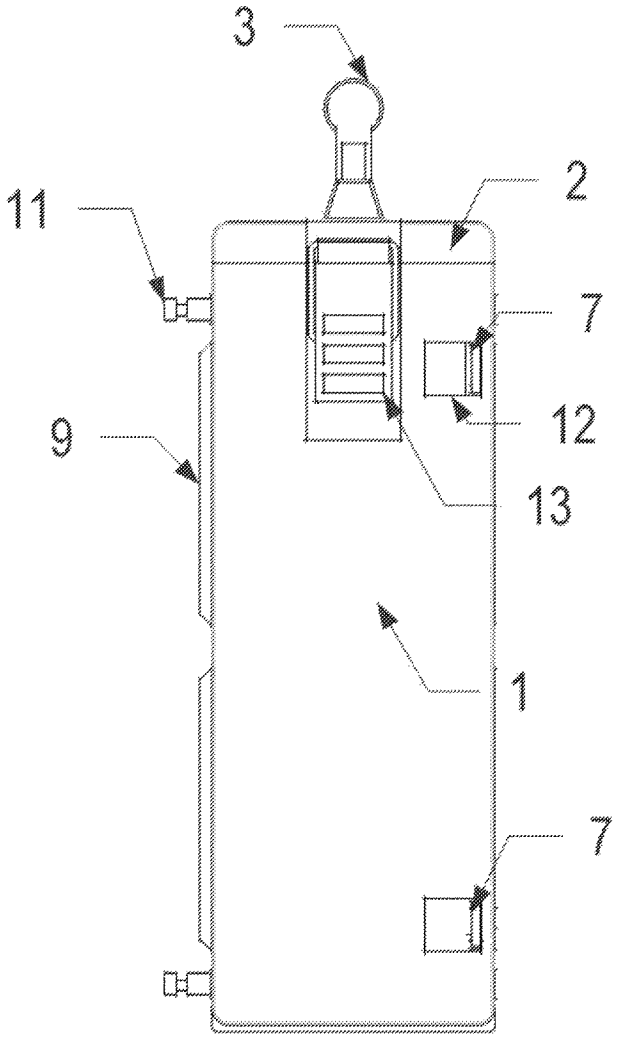
FIGS. 5-6 are front and back elevation views, respectively, of the modular container according to the embodiment of FIGS. 1-2.
Figure 6:
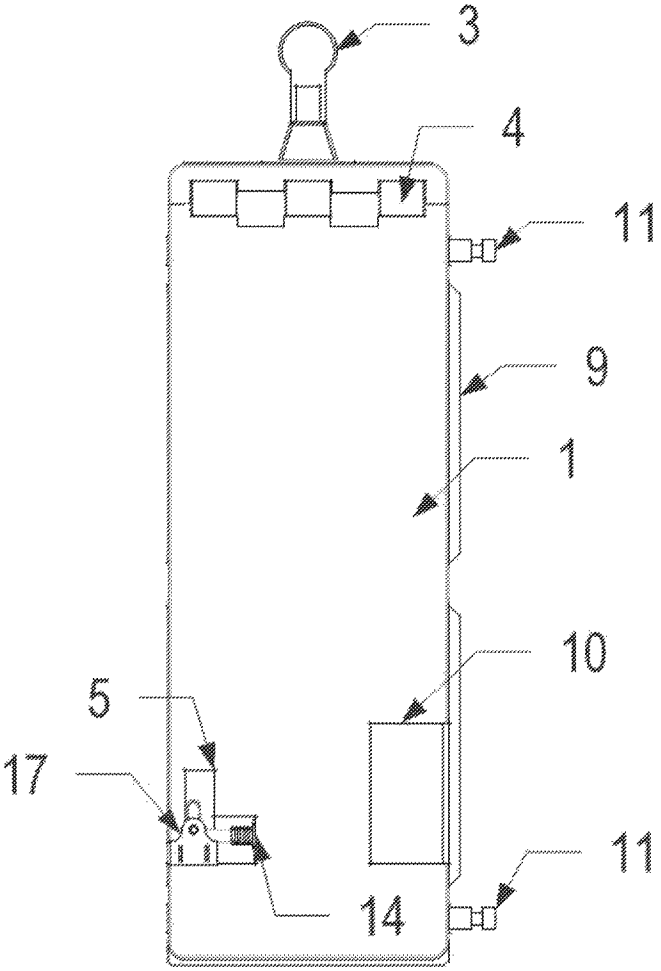
Figure 7:
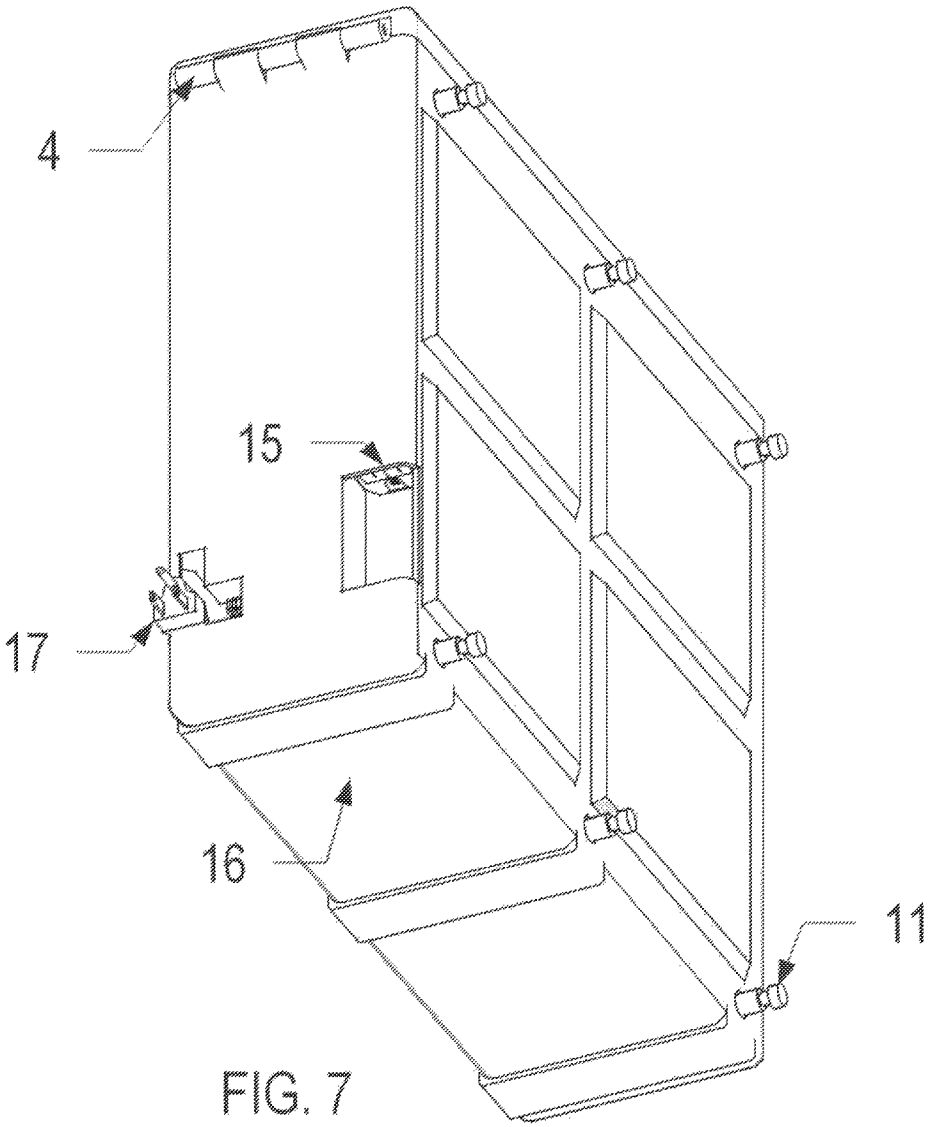
FIG. 7 is a left three-quarter perspective view (that also shows the back and bottom sides) of the modular container according to the embodiment of FIGS. 1-2.

FIGS. 1-2 are left and right three-quarter perspective views, respectively, of a modular container according to an embodiment of the present invention. FIGS. 3-4 are right and left elevation views, respectively, of the modular container according to the embodiment of FIGS. 1-2. FIGS. 5-6 are front and back elevation views, respectively, of the modular container according to the embodiment of FIGS. 1-2. And FIG. 7 is a left three-quarter perspective view (that also shows the back and bottom sides) of the modular container according to the embodiment of FIGS. 1-2.

In FIGS. 1-7, such a container, e.g., a carry-case, a transit-case, etc. is shown. Such a case can include: a body 1; a lid 2; a handle 3 for carrying the container; a hinge 4 for lid 2; an opening 5 in body 1 at which is disposed power cord plug 17; apertures 6 (formed in the right side of body 1, serving as female aspects) and corresponding posts 11 (located on the left side of body 1, serving as male aspects) configured for removable engagement, respectively; body recesses 8 formed in the right side of body 1 and corresponding mesas 9 (multiples instances of a mesa) formed on the left side of body 1 configured for removable engagement, respectively; attachment members 7 (flanges with apertures therein that can serve as parts of locking mechanisms) that are partially disposed inside body 1 but that also extend through openings 12 in body 1 so as to stand proud of the sides (e.g., front sides) of body 1; a recess 10 in the side (e.g., the back side) of body 1, there being disposed at one end of recess 10 a receptacle 15 correspondingly configured to engage with an instance of plug 17; a latch 13 to serve as a closure-mechanism for lid 2; and an opening 5 in body 1 through which can pass a power cord 17. Power cords 17 may be standard 120V cords, or may be low voltage, e.g. 18V, with the assembly making use of a central power transformer.

Figure 8:
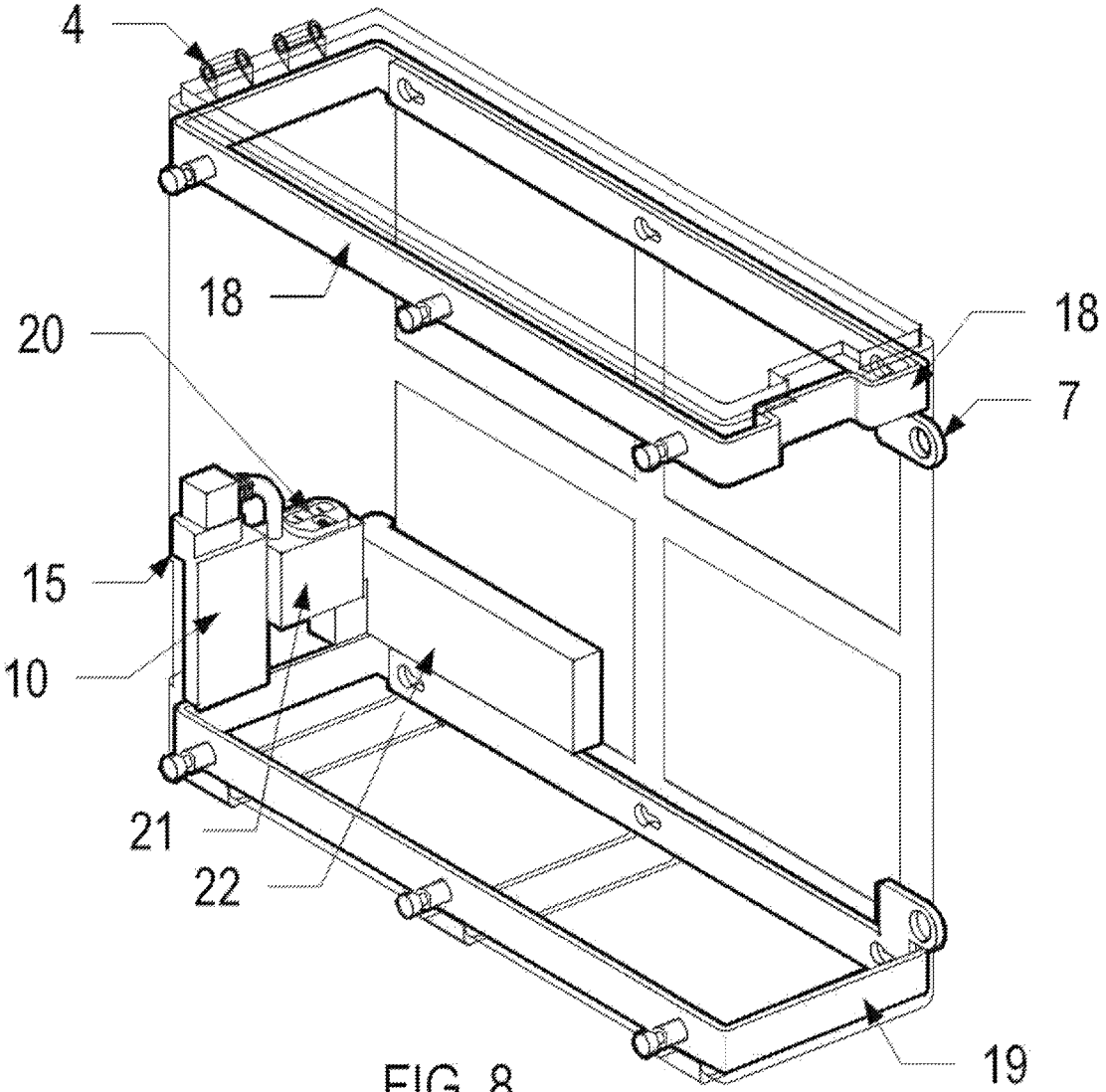
FIGS. 8-9 are left and right three-quarter perspective views, respectively, of interior features, e.g., power-outlet and power-cord management features, of a modular container according to another the embodiment of FIGS. 1-2.
Figure 9:
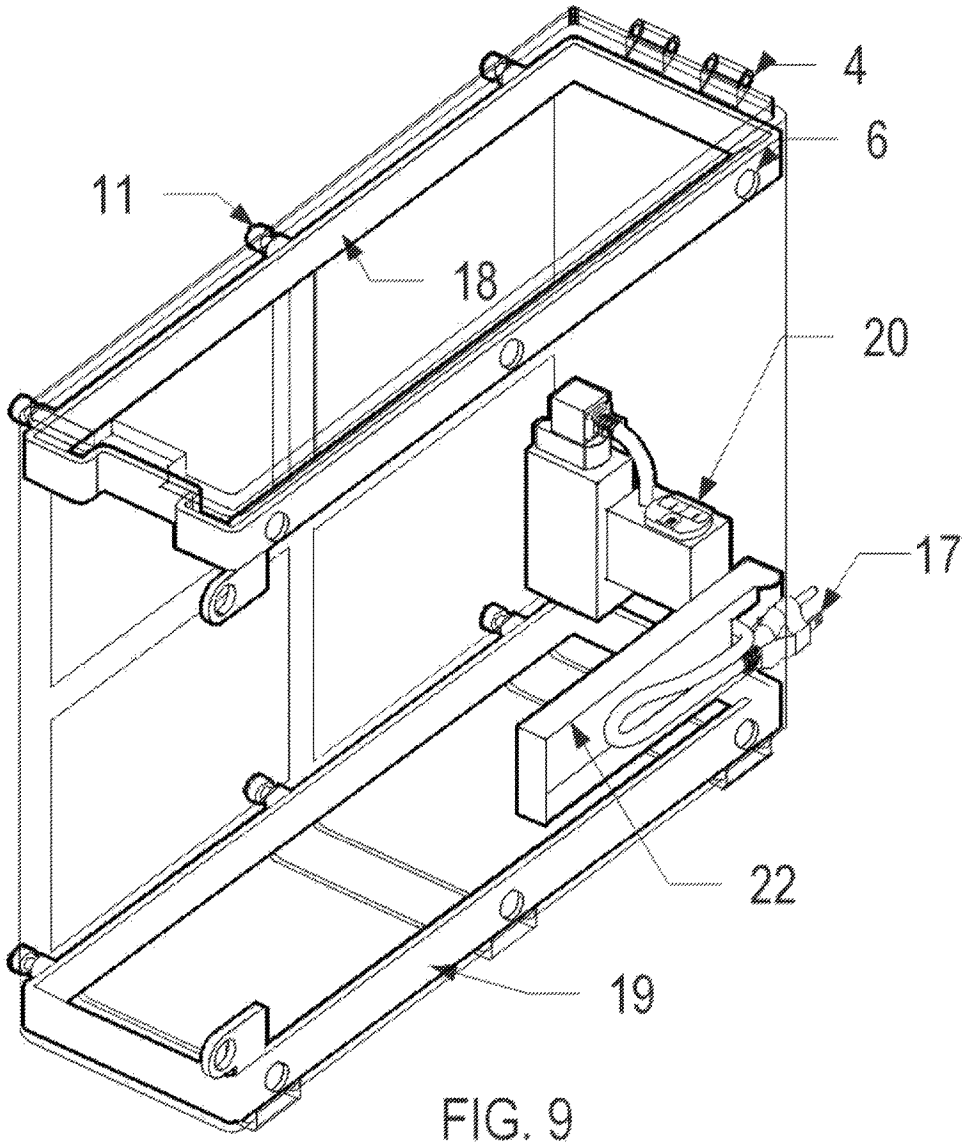

FIGS. 8-9 are left and right three-quarter perspective views, respectively, of interior features, e.g., power-outlet and power-cord management features, of a modular container according to another embodiment of the present invention.

In FIGS. 8-9, interiors of such containers include: an upper rim stiffener 18; a lower rim stiffener 19; an internal receptacle 20, which as illustrated is a conventional outlet for powering, e.g., a battery charger, power tools, or other devices inside, although in other embodiments it may constitute any kind of electrical connection/connector; a power junction box 21; a garage-box 22 for storage of slack-length of a power cord 17; and apertures 23, formed in upper rim stiffener 18 and lower rim stiffener 19, sized and aligned with apertures 6 so as to enhance the female aspects of the removable engagement vis-a-vis corresponding posts 11, respectively.

Figure 10A:
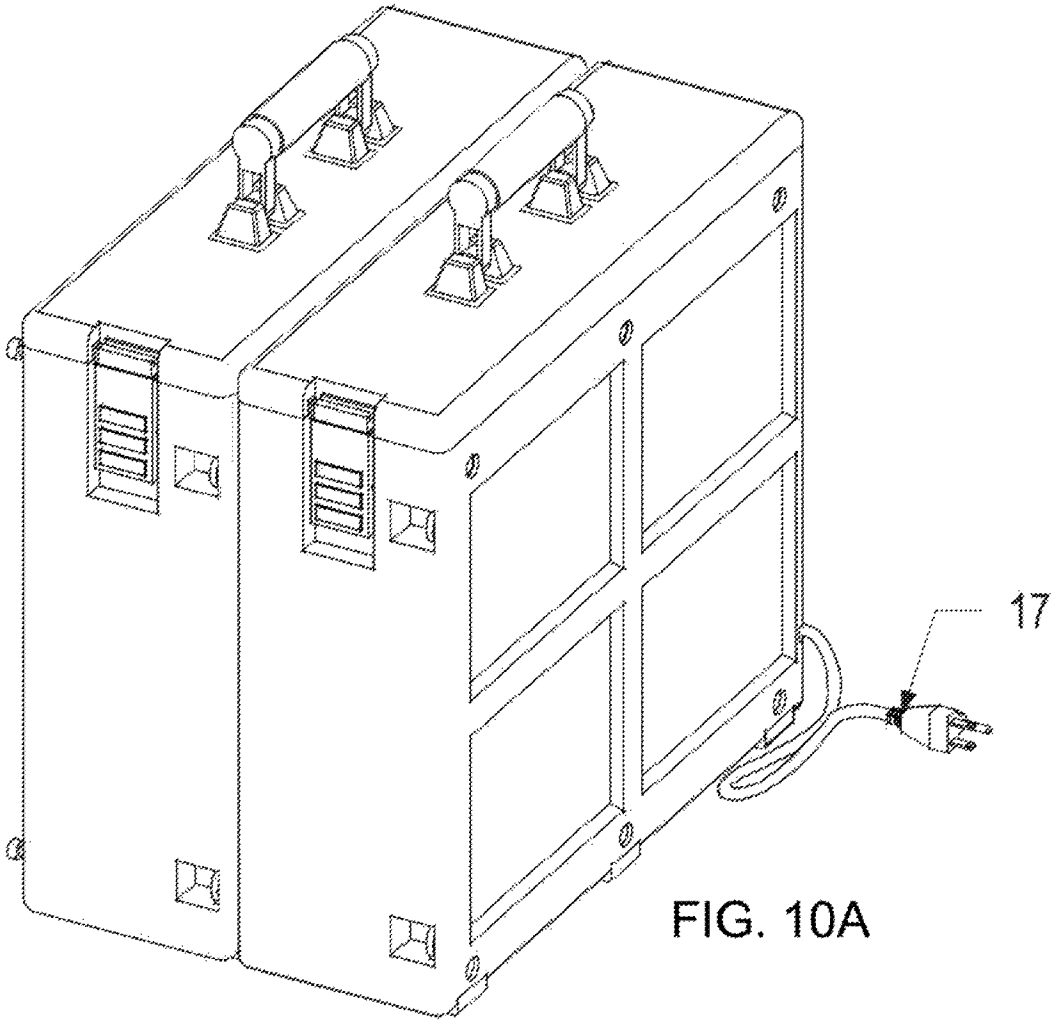
FIG. 10A is a left three-quarter perspective view demonstrating two boxes attached to each other but with no carrier bar
Figure 10B:
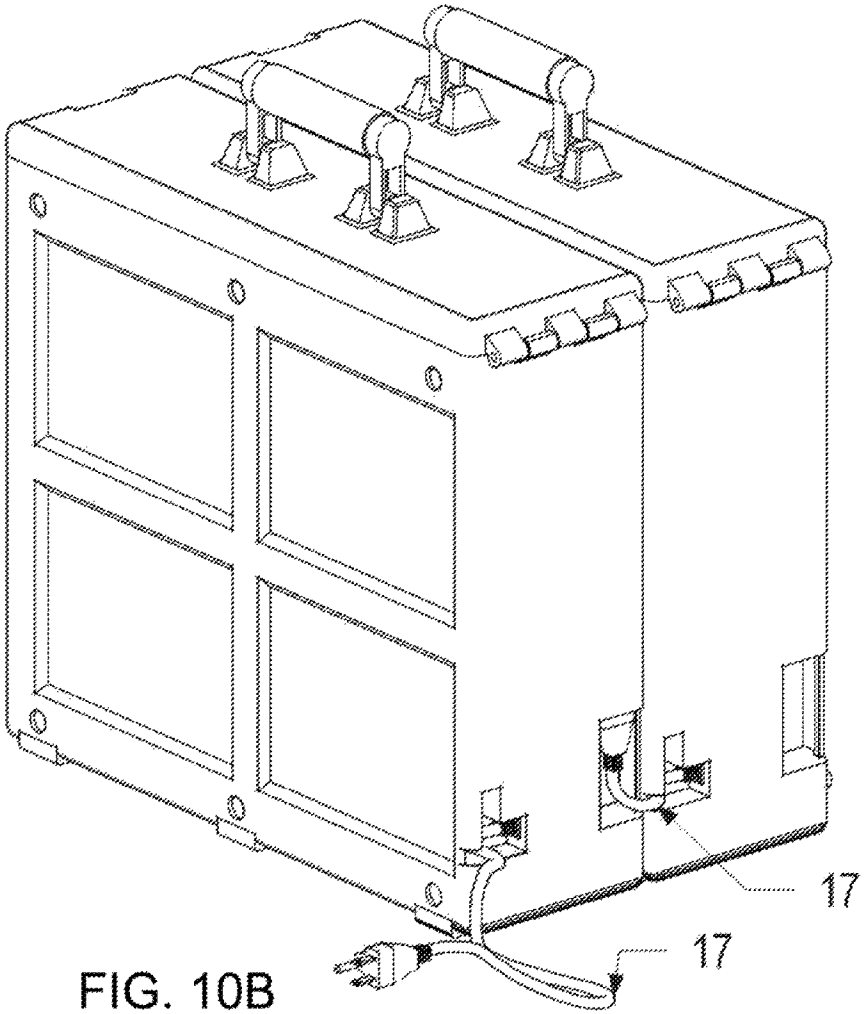
FIG. 10B is the same as FIG. 10A but from the back demonstrating the transfer of power between connected boxes.

FIG. 10A is a left three-quarter perspective view demonstrating two boxes attached to each other but with no carrier bar. FIG. 10B is the same as FIG. 10A but from the back demonstrating the transfer of power between connected boxes.

Figure 11:
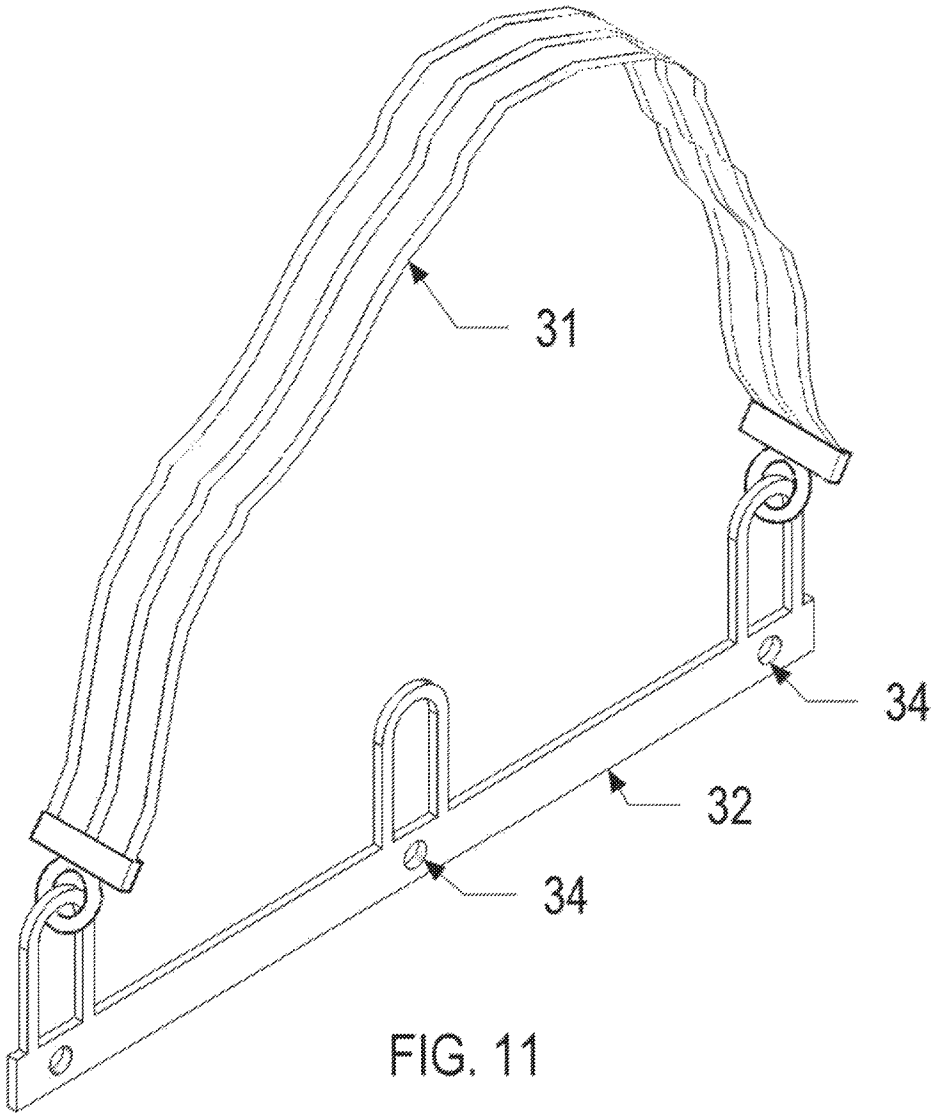
FIG. 11 is a three-quarter perspective view of a strap assembly (for a pair of modular containers) according to another embodiment of the present invention.

FIG. 11 is a three-quarter perspective view of a strap assembly (for a pair of modular containers) according to another embodiment of the present invention.

In FIG. 11, the strap assembly includes: a strap 31 that, when attached to a container or a pair of containers, facilitates manual lifting and transport thereof; a bar 32 having a length substantially corresponding to the distance between back and front sides of a corresponding container; attachment loops 33 attached to bar 32; and apertures 34, formed in bar 32, sized and aligned with corresponding posts 11 on bodies 1, apertures 34 providing a female aspect vis-a-vis the male aspect of posts 11, respectively.

Figure 12:
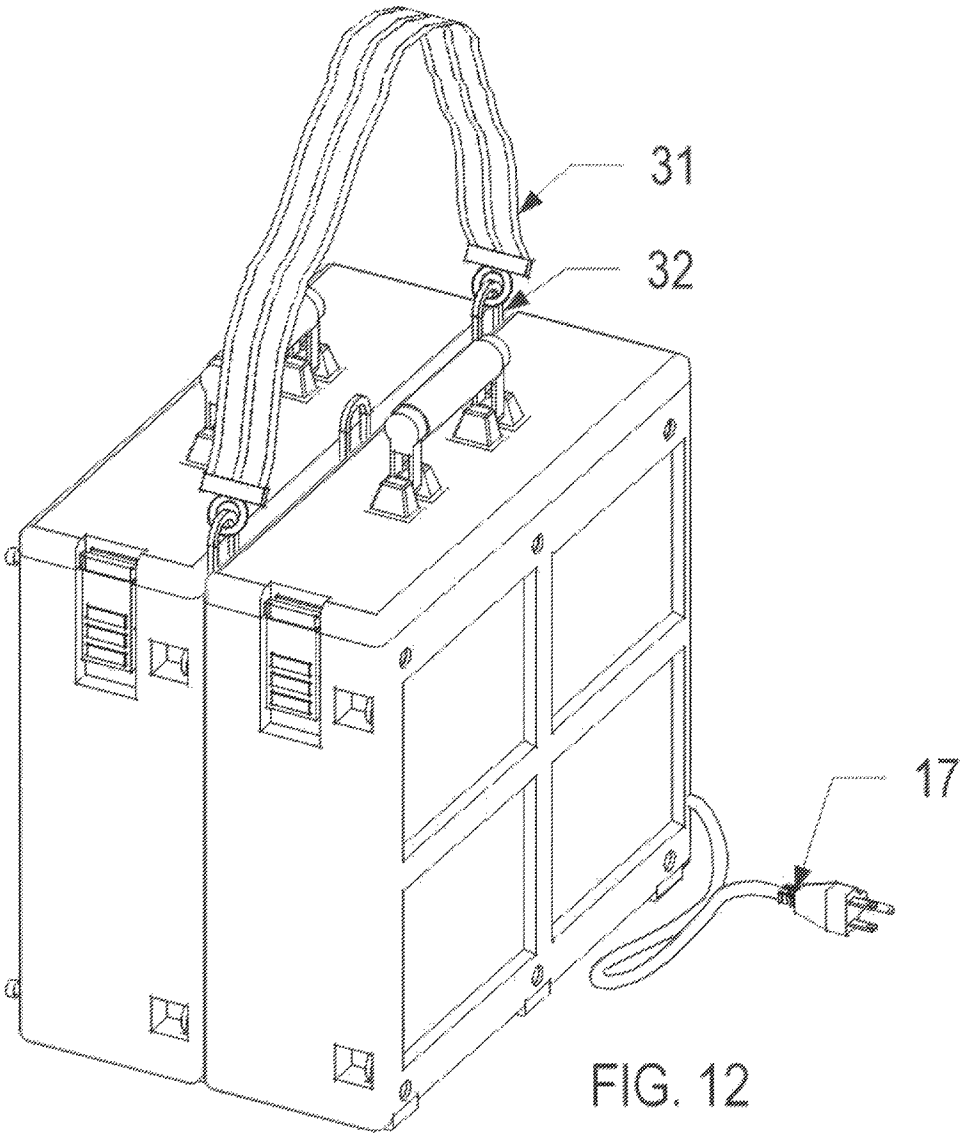
FIG. 12 is a right three-quarter perspective view of the carry-strap assembly of FIG. 11 mounted to a pair of modular containers.
Figure 13:
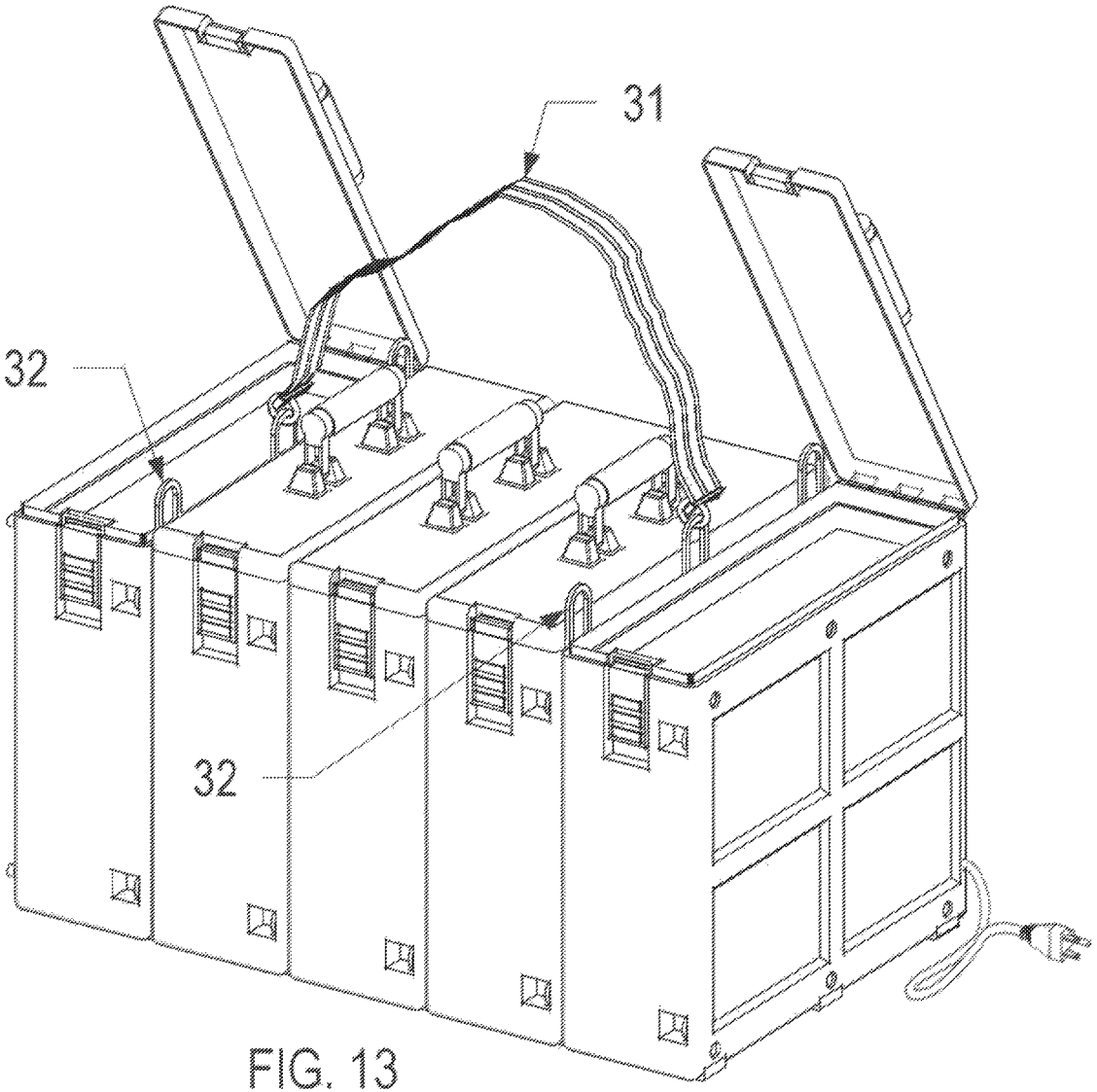
FIG. 13 is a left three-quarter perspective view, of two carry-strap assemblies of FIG. 11 mounted to a plurality of modular containers.

FIG. 12 is a right three-quarter perspective view of the carry-strap assembly of FIG. 11 mounted to a pair of modular containers;

FIG. 13 is a right three-quarter perspective view of two carry-strap assemblies of FIG. 11 mounted to a plurality of assembled modular containers.

In FIG. 12, the strap assembly of FIG. 11, in particular bar 32, can be described as being sandwiched between two containers.

Multiple containers stacked as in FIGS. 12-13 represent other examples of a container-assembly according to an embodiment of the present invention. By inspection of FIGS. 12-13, it should be apparent that advantages of such a container-assembly include: such interlocking of the containers with one another establishes an at least semi-rigid arrangement that facilitates simultaneous conveyance of multiple containers; and that it is not necessary to disassemble the container-assembly in order to gain access to the contents of any of the individual containers.

Figure 14:
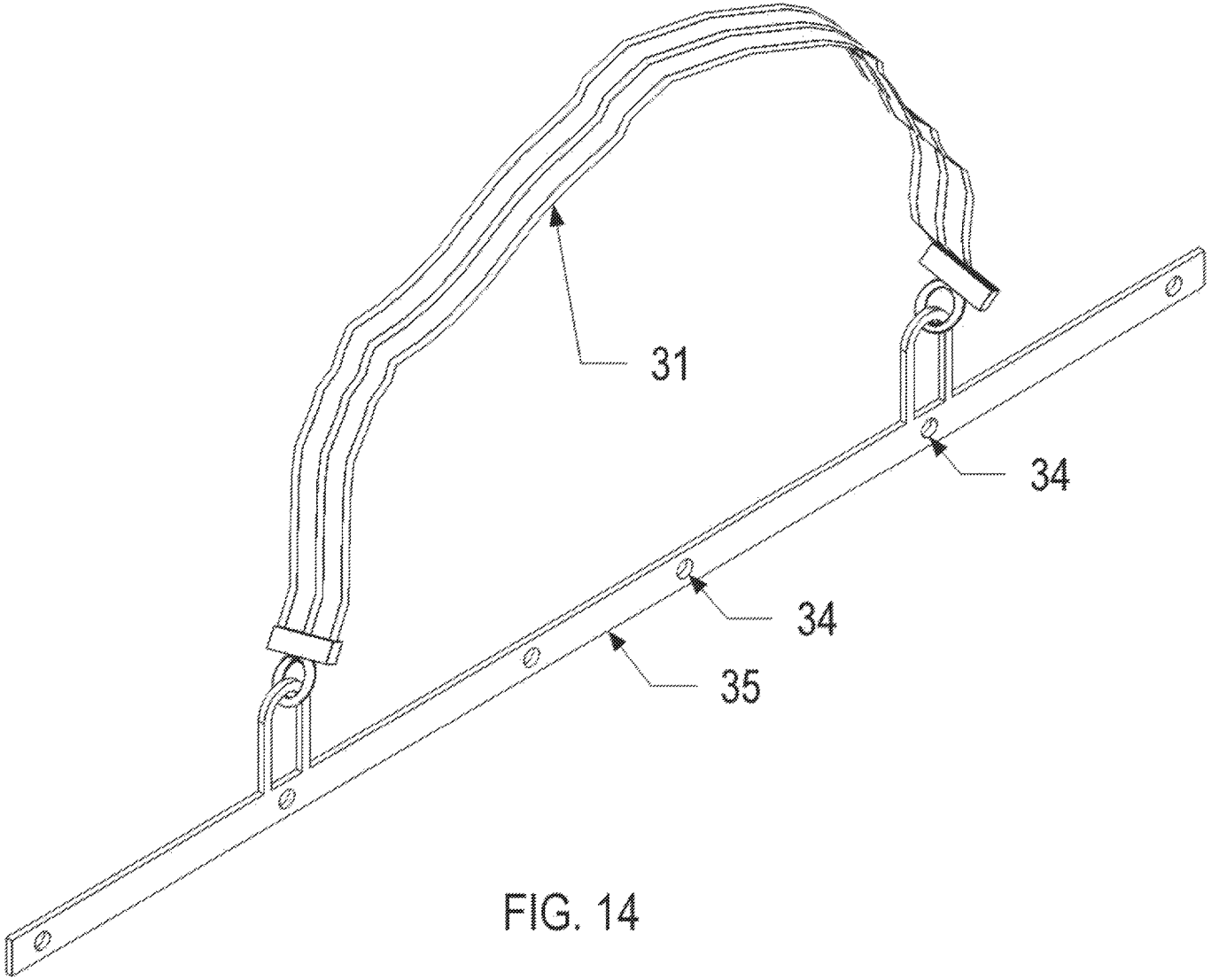
FIG. 14 is a three-quarter perspective view of a double-length strap assembly (for two pairs of modular containers) according to another embodiment of the present invention.

FIG. 14 is a three-quarter perspective view of a double-length strap assembly (for two pairs of modular containers) according to another embodiment of the present invention.

In FIG. 14, the strap assembly includes a bar 35 having a length substantially corresponding to twice the distance between back and front sides of a corresponding container in addition to a gap allowing for space between back-to-back containers within the assembly. The instance of strap 31 illustrated in FIG. 14 can be proportionately longer than the instance of strap 31 illustrated in FIG. 11.

Figure 15A:
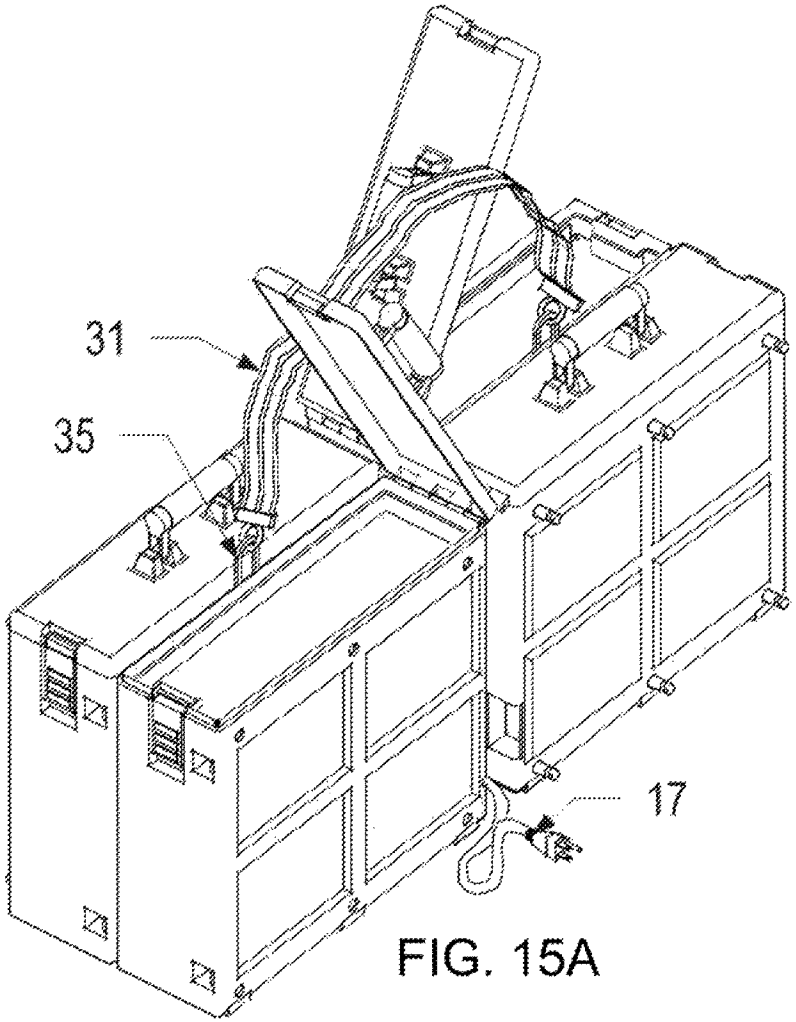
FIGS. 15A and 15B are three-quarter perspective views of the double-length carry-strap assembly of FIG. 14 mounted to two pairs of modular containers.
Figure 15B:
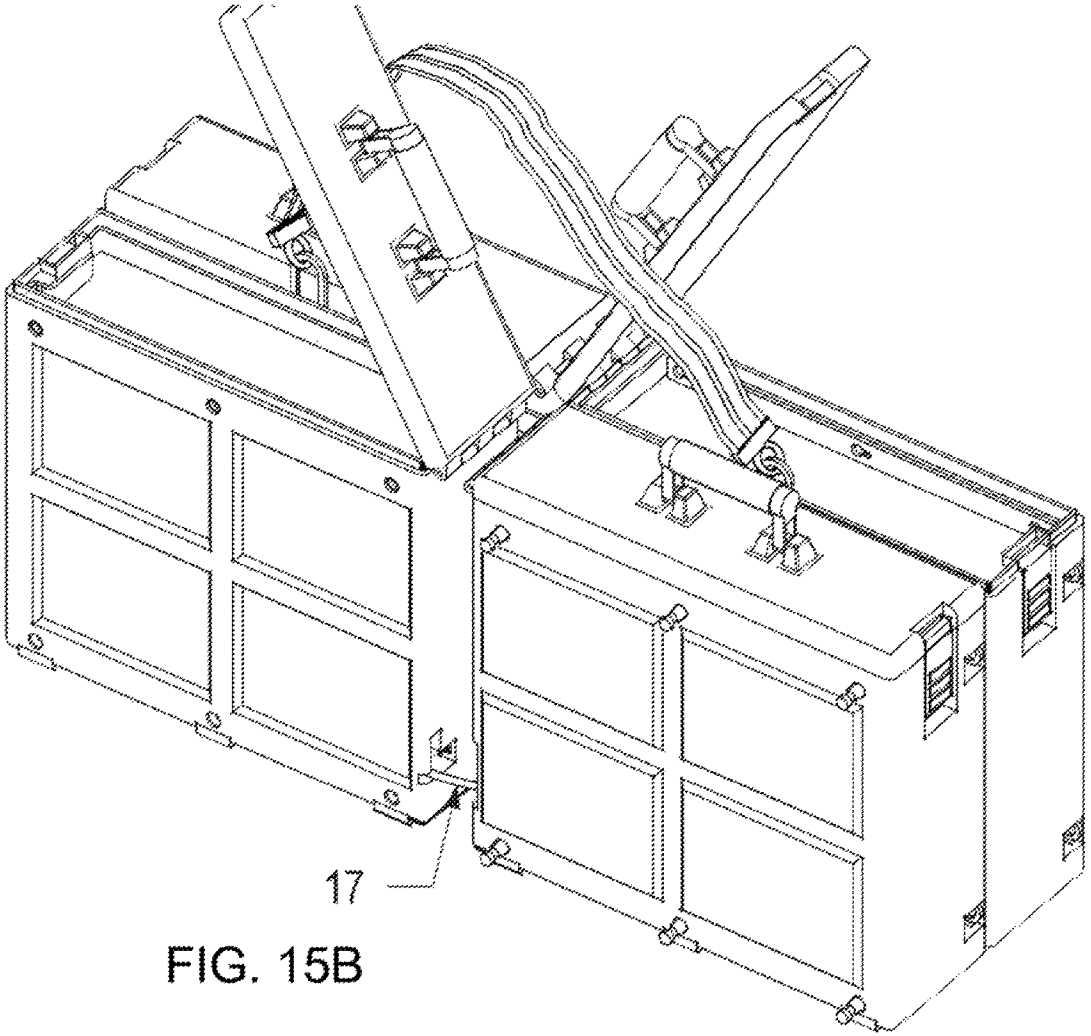

FIGS. 15A-15B are three-quarter perspective views of the double-length carry-strap assembly of FIG. 14 mounted to two pairs of modular containers.

In FIGS. 15A-15B, the strap assembly of FIG. 14, in particular bar 35, can be described as being sandwiched between each of two pairs of containers, and thus as connecting the two pairs of containers. In FIG. 15A, it is noted that an instance of lid 2 in one of the container-pairs and an instance of lid 2 in one of the containers of the other container-pair are illustrated as disposed in open positions, respectively.

In FIG. 15B, it is noted that an instance of power cord 17 provides a power connection between a container of the first pair of containers and a container of the second pair of containers.

Multiple containers stacked as in FIGS. 15A-15B represent another example of a container-assembly according to an embodiment of the present invention. By inspection of FIGS. 15A-15B, it should be apparent that advantages of such a container-assembly include: such interlocking of the containers with one another establishes an at least semi-rigid arrangement that facilitates simultaneous conveyance of multiple containers; and that it is not necessary to disassemble the container-assembly in order to gain access to the contents of any of the individual containers; and that all containers may be simultaneously powered by a single power cord.

Figure 16:
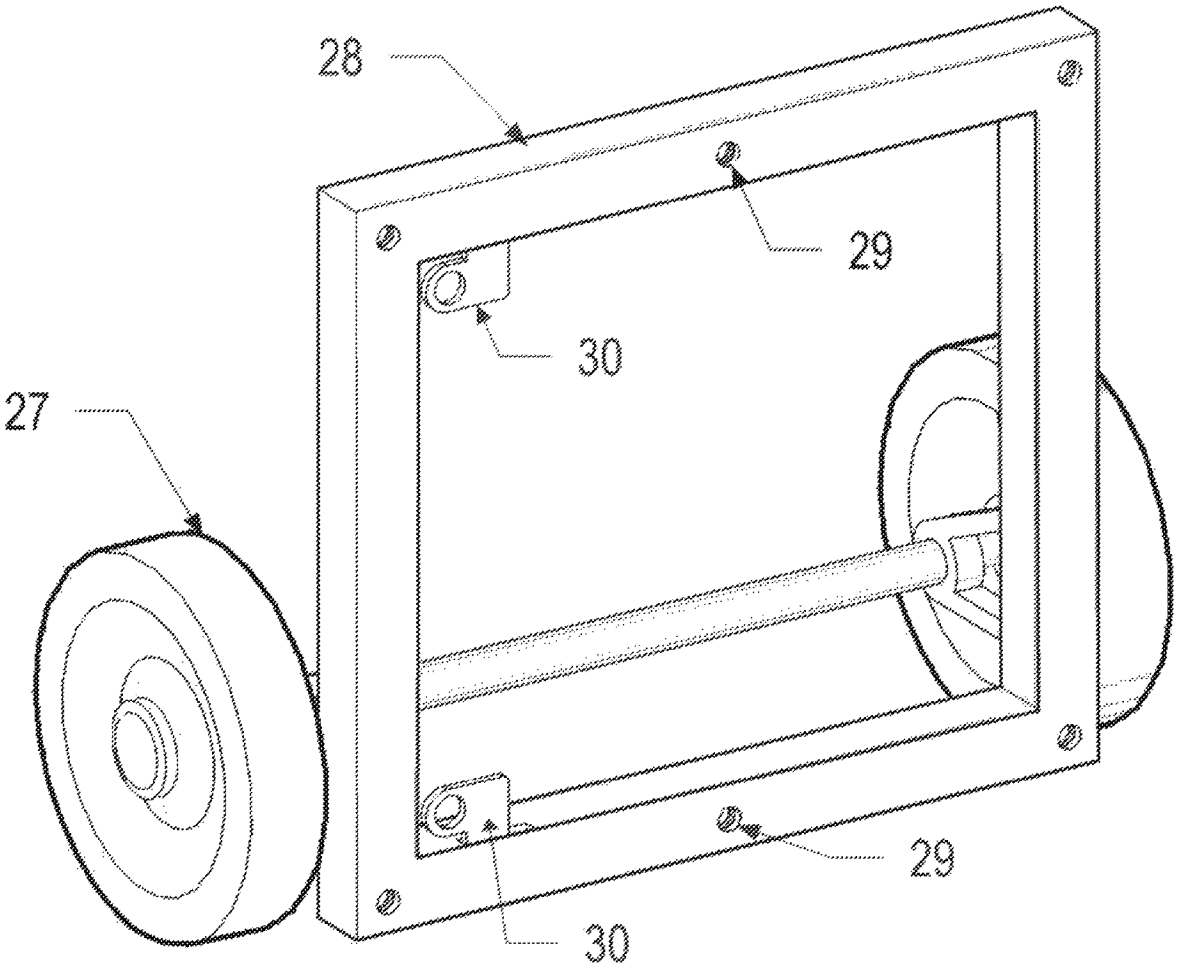
FIG. 16 is a right, three-quarter perspective view of a wheel assembly (for a modular container) according to another embodiment of the present invention.

FIG. 16 is a right, three-quarter perspective view of a wheel assembly (for a modular container) according to another embodiment of the present invention.

In FIG. 16, the wheel assembly includes: a frame 28; wheels 27 attached to frame 28; and apertures 29, formed in the right side of frame 28, sized and aligned with corresponding posts 11 on bodies 1, apertures 29 providing a female aspect vis-a-vis the male aspect of posts 11 for purposes of removable engagement, respectively.

Figure 17:
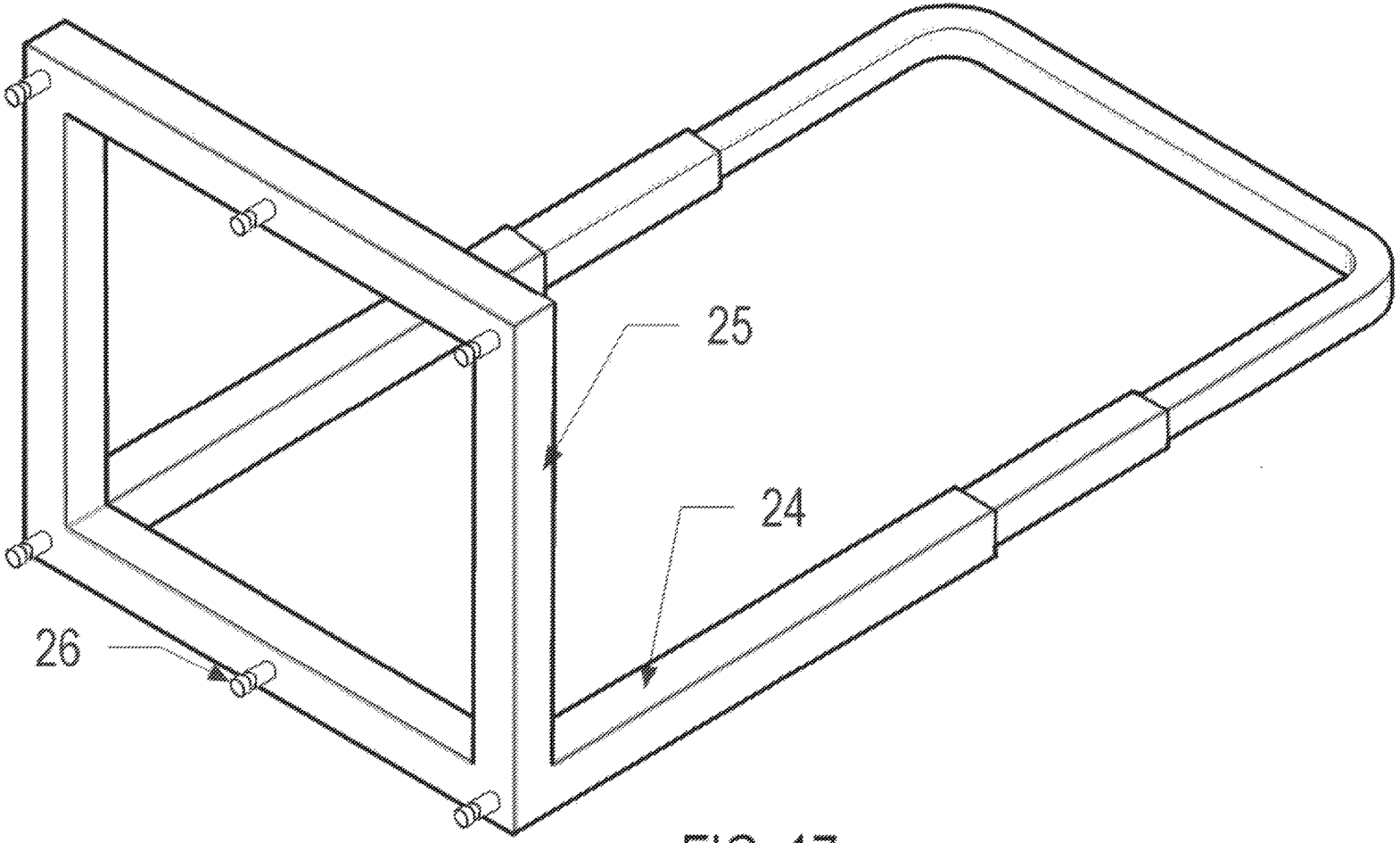
FIG. 17 is a left-side, three-quarter perspective view of a handle assembly (for a modular container) according to another embodiment of the present invention.

FIG. 17 is a left, three-quarter perspective view of a handle assembly (for a modular container) according to another embodiment of the present invention.

In FIG. 17, the handle assembly includes: a U-shaped handle 24; an attachment frame 25; and posts 11 (located on the left side of frame 25, serving as a male aspect). Handle 24 can be attached, e.g., to the right side of frame 25.

Figure 18:
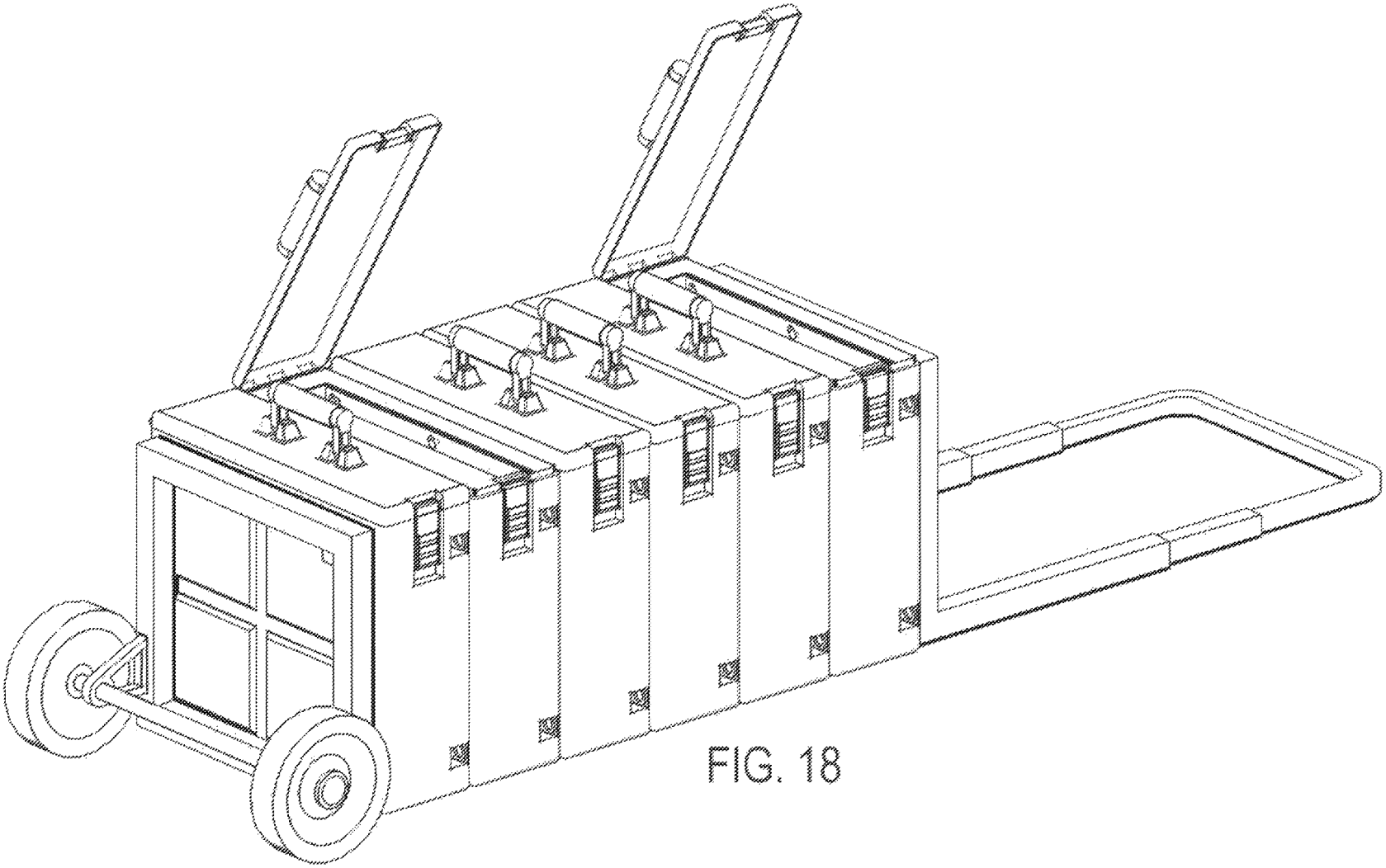
FIGS. 18-20 are three-quarter perspective views, respectively (with FIG. 18 illustrating the top and front sides of the containers and the left side of one of the modules, and with FIG. 19 illustrating the top and back sides of the containers and the right side of one of the modules, and power transfer between the modules, and FIG. 20 illustrating the front and top sides of the containers with the hand-truck in an upright position) of a hand-truck assembly, according to an embodiment of the present, including a plurality modular containers arranged in a container-assembly.
Figure 19:
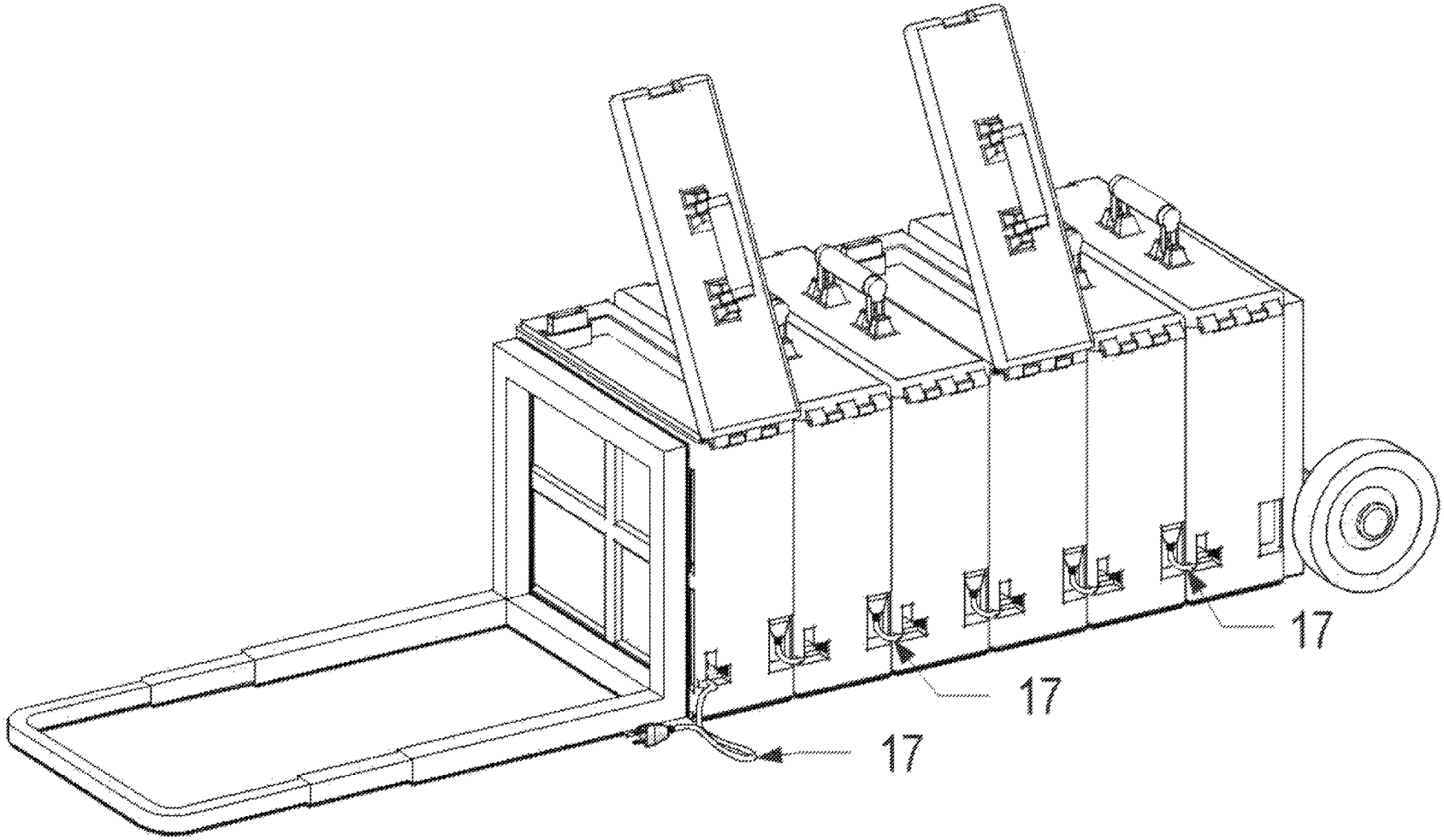
Figure 20:
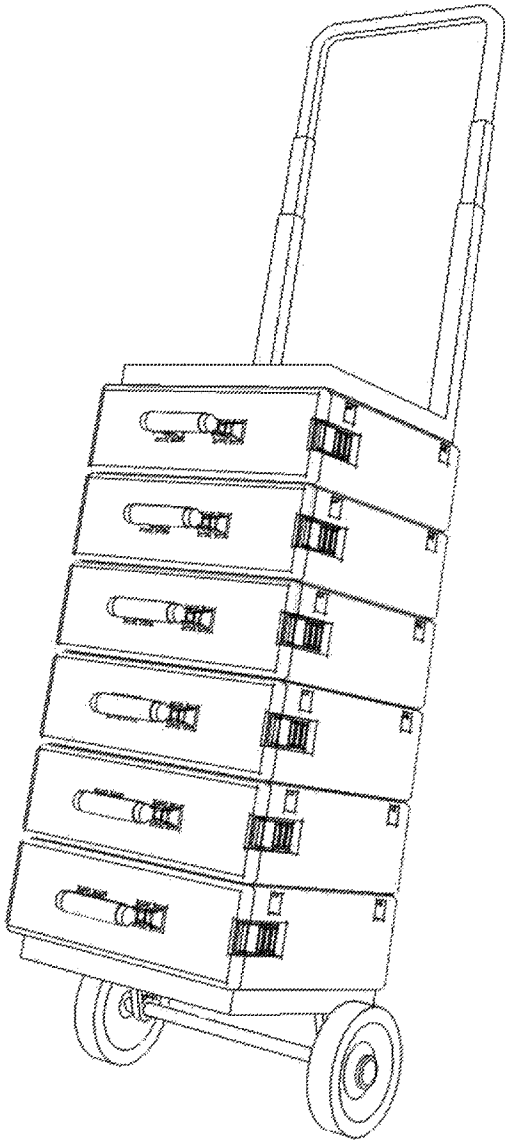
Figure 21A:
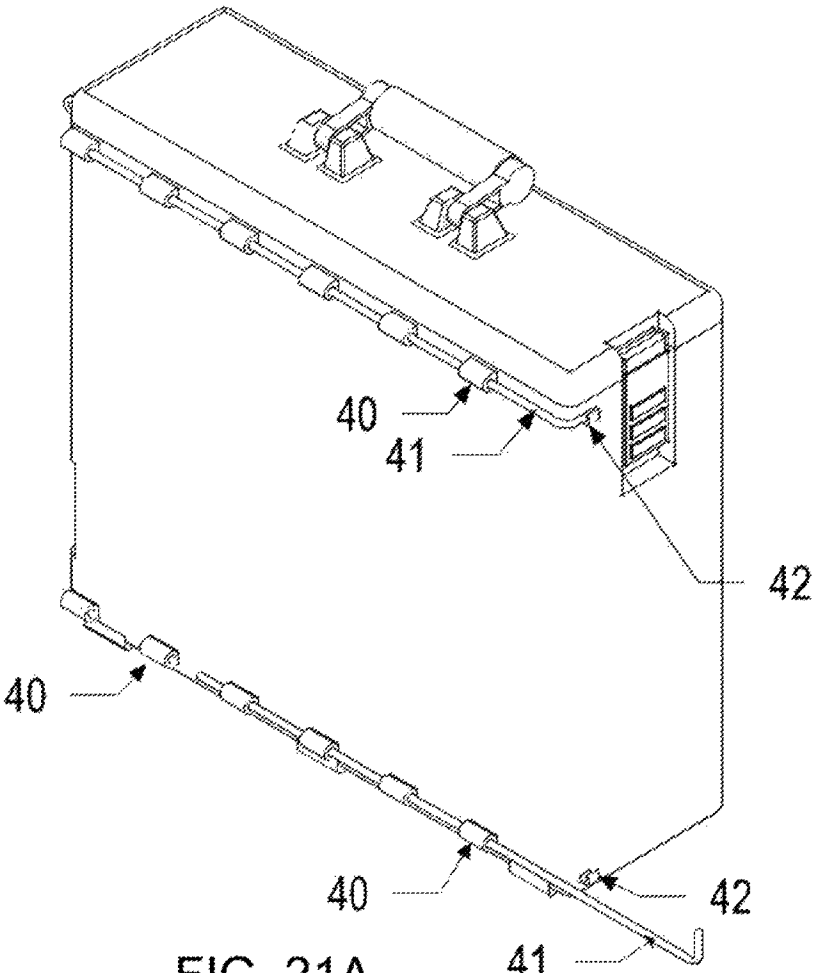
FIGS. 21A, 21B, and 22 illustrate an embodiment of the invention in which a sleeve and rod device is used to connect the modules, with FIG. 21A being a left three-quarter perspective, FIG. 22 a right three-quarter perspective and FIG. 21B a close-up view.
Figure 21B:
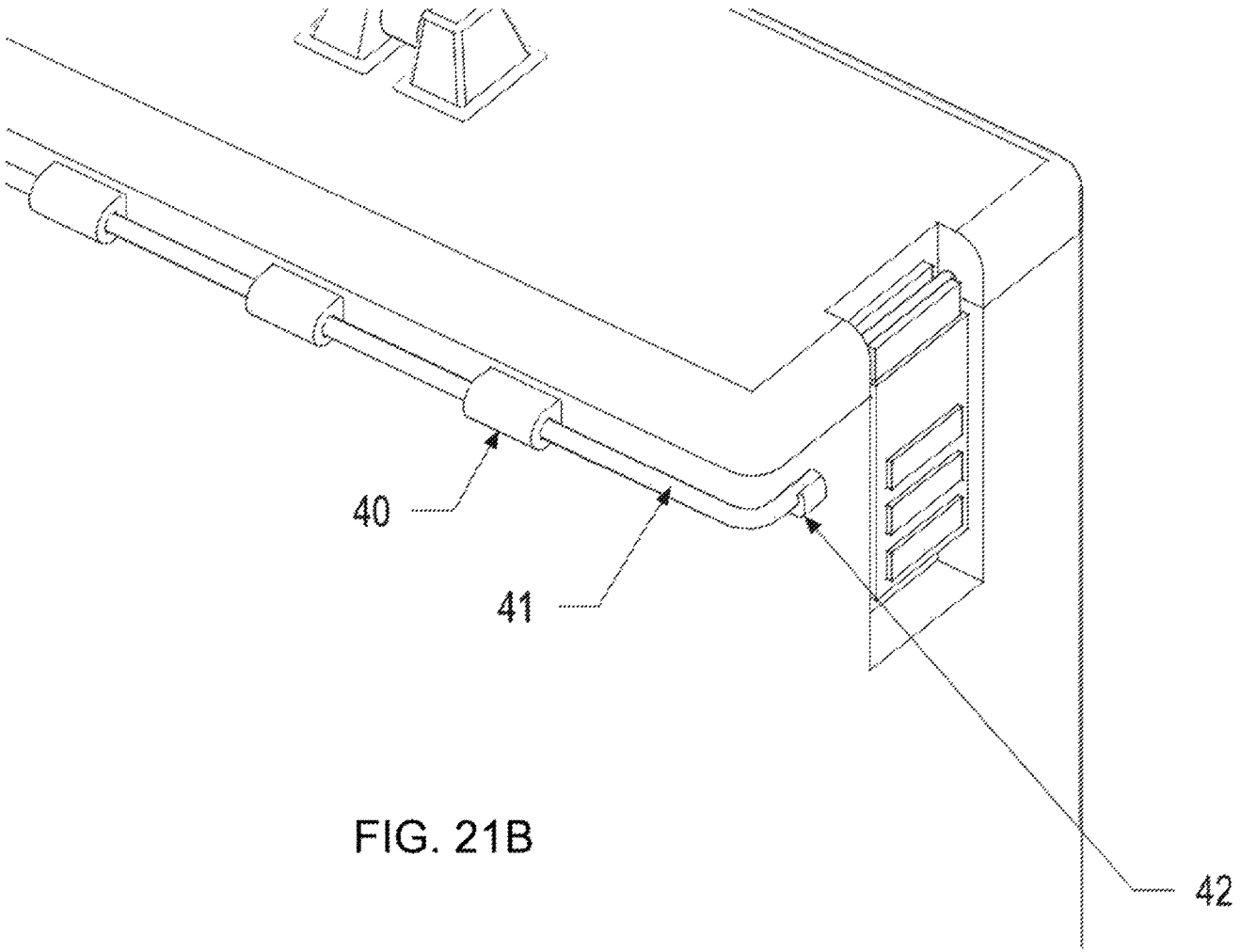

In FIGS. 18-20, a plurality of modular containers are illustrated as being arranged in a container-assembly, with the left side of the container-assembly being disposed on the wheel assembly of FIG. 16, and with the handle assembly of FIG. 17 being disposed on the right side of the container-assembly. Multiple containers stacked as in FIGS. 18-20 represent an example of a container-assembly according to an embodiment of the present invention.

Together, the wheel assembly, container-assembly and the handle assembly of FIGS. 18-20 comprise the hand-truck assembly. It is noted that lid 2 of two of the containers are illustrated in FIGS. 18-19 as being disposed in an open position. Posts 11 (located on the left sides of bodies 1, serving as male aspects) removably engage apertures 6 (formed in the right sides of bodies 1) and apertures 29 (formed in the right side of frame 28) serving as female aspects, respectively. By inspection of FIGS. 18-20, it should be apparent that advantages of such a container-assembly include: such interlocking of the containers with one another establishes an at least semi-rigid arrangement that facilitates simultaneous conveyance of multiple containers; and that it is not necessary to disassemble the container-assembly in order to gain access to the contents of any of the individual containers; and that all containers may be powered simultaneously with a single power cord.

Also in FIG. 19 are illustrated: jumper cords 17 for providing power connections between adjacent containers in a daisy-chain type of configuration; and a power cord 17 extendable from the corresponding container, with slack-length of power cord 17 being storable in internal garage-box 22 of the container. FIG. 20 illustrates the front and top sides of the containers with the hand-truck in an upright position.

Figure 22:
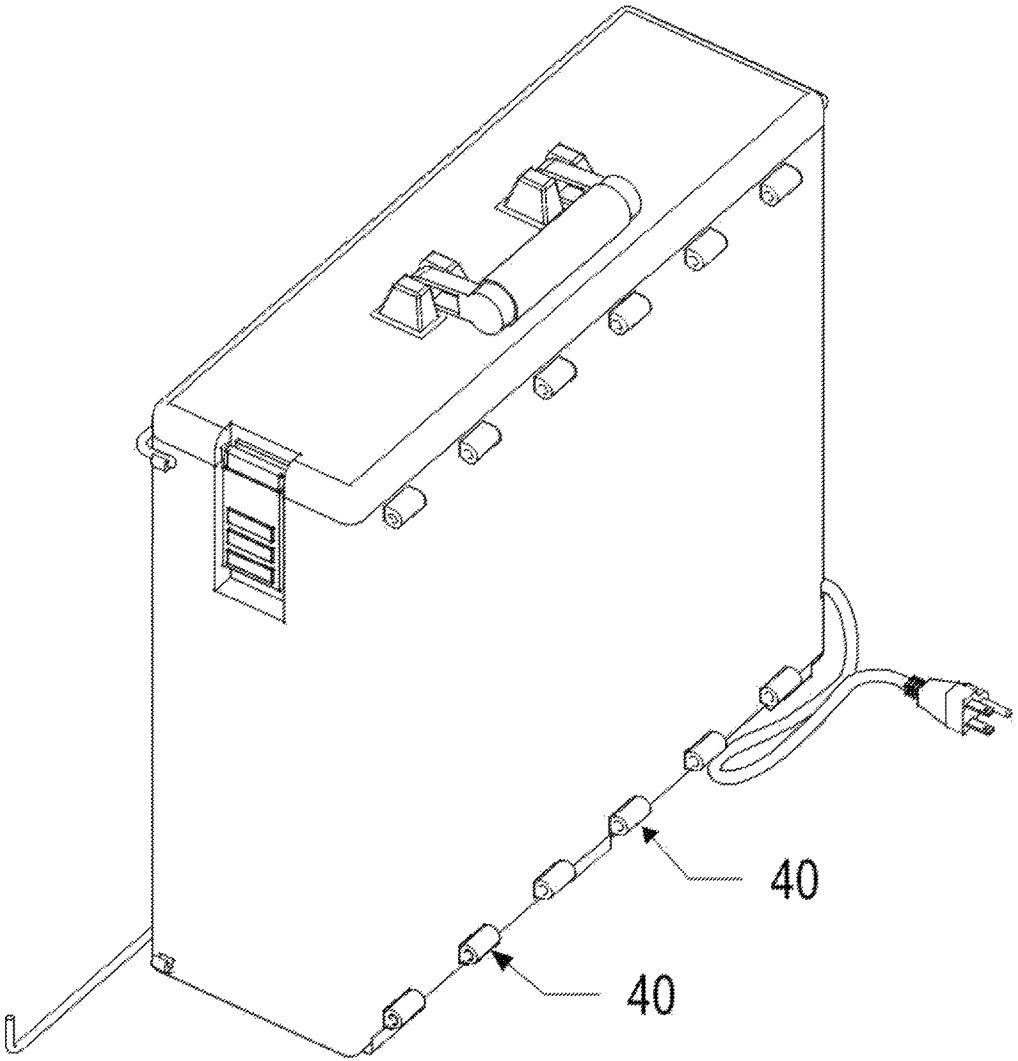
Figure 23A:
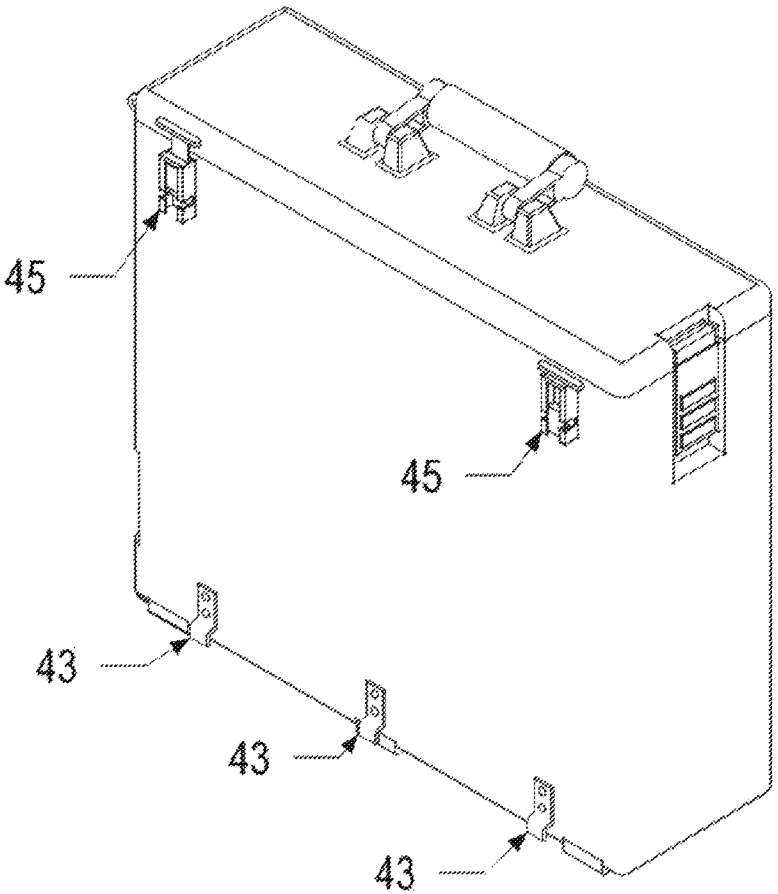
FIGS. 23A, 23B, 23C, and 24 illustrate an embodiment of the invention in which a hook, loop and latch system is used to connect the modules, with FIG. 23A being a left three-quarter perspective, FIG. 24 being a right three-quarter perspective, and FIGS. 23B and 23C being close-up views of FIG. 23A near the bottom front and top front, respectively.
Figure 23B:
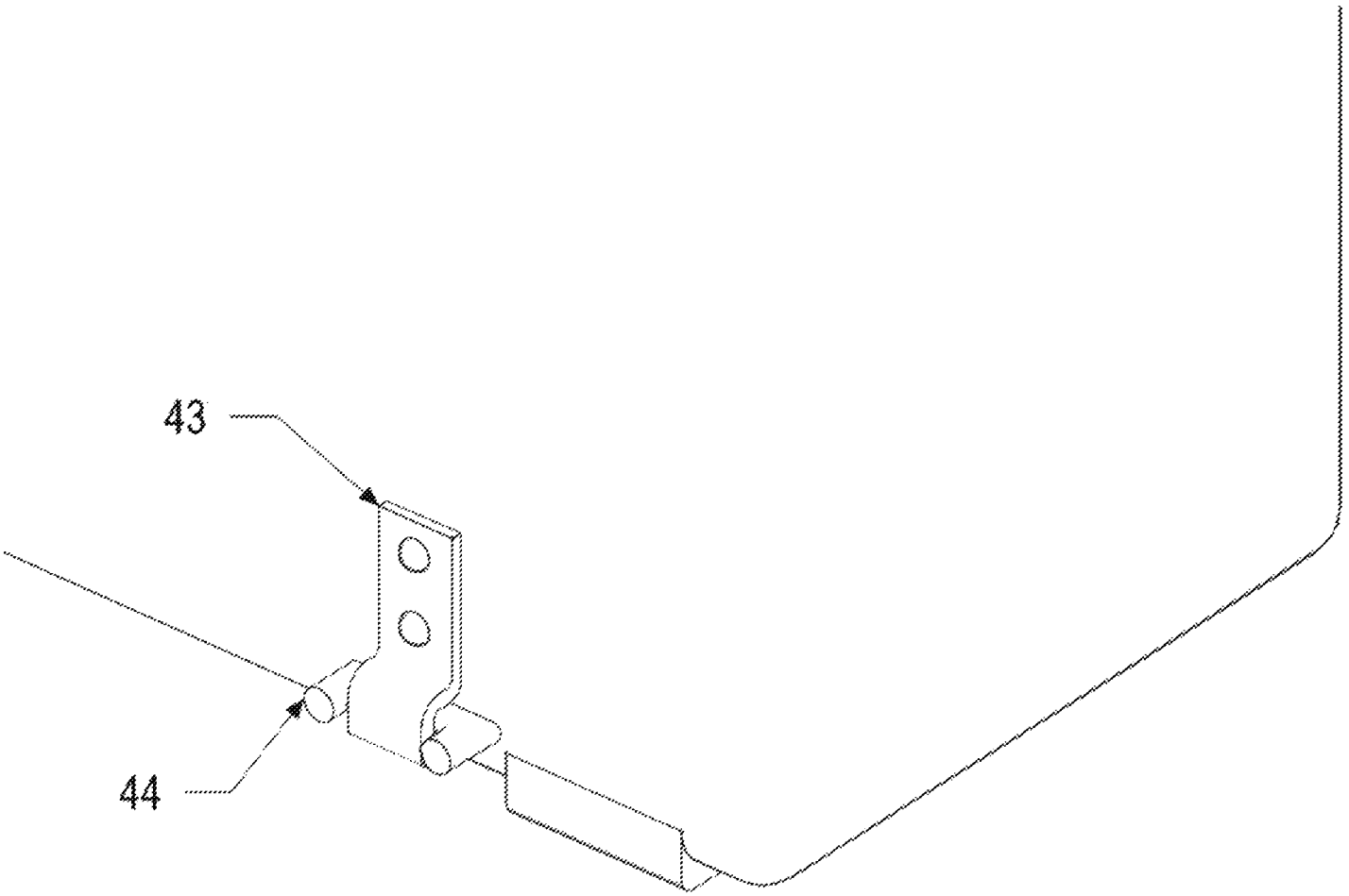
Figure 23C:
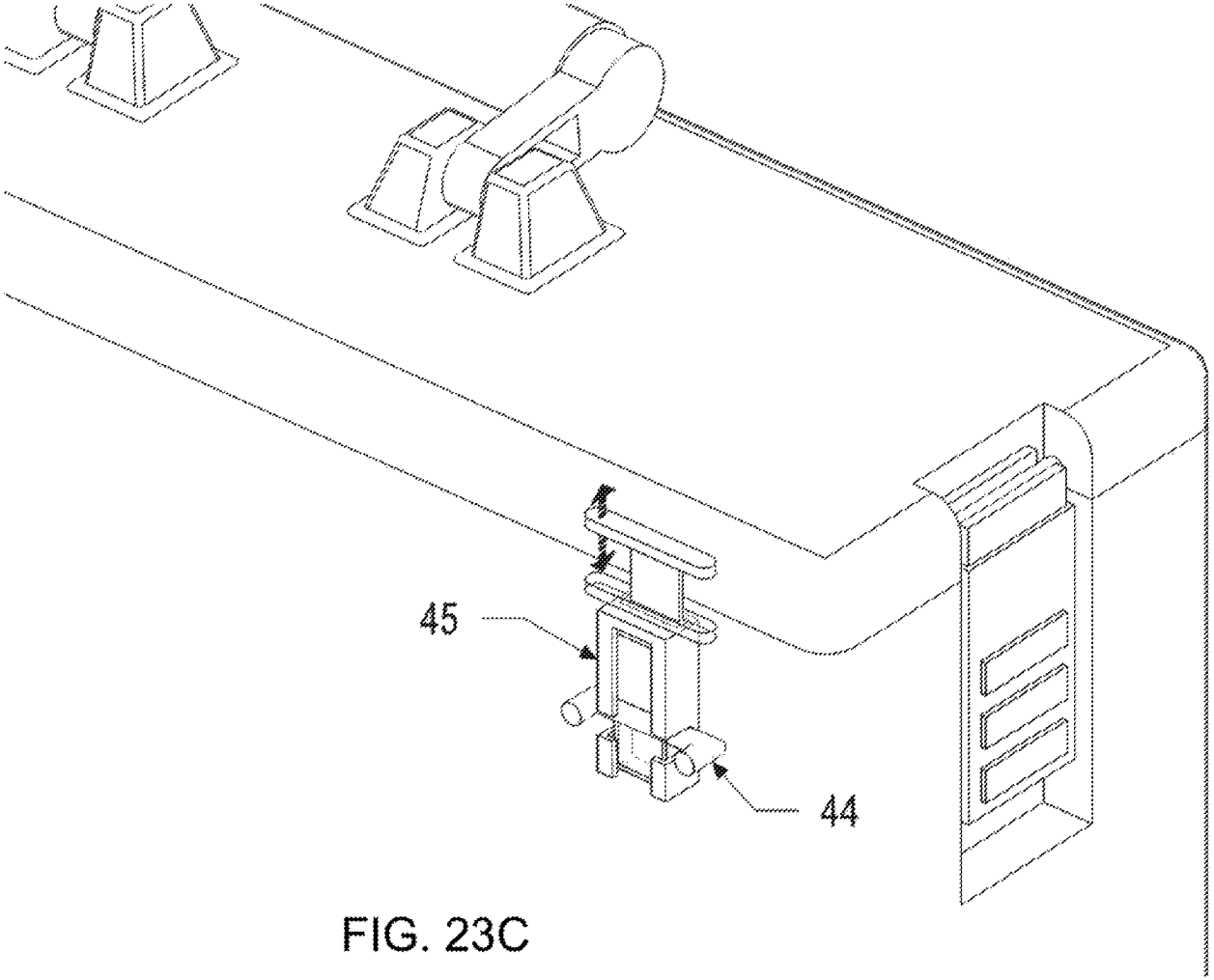
Figure 24:
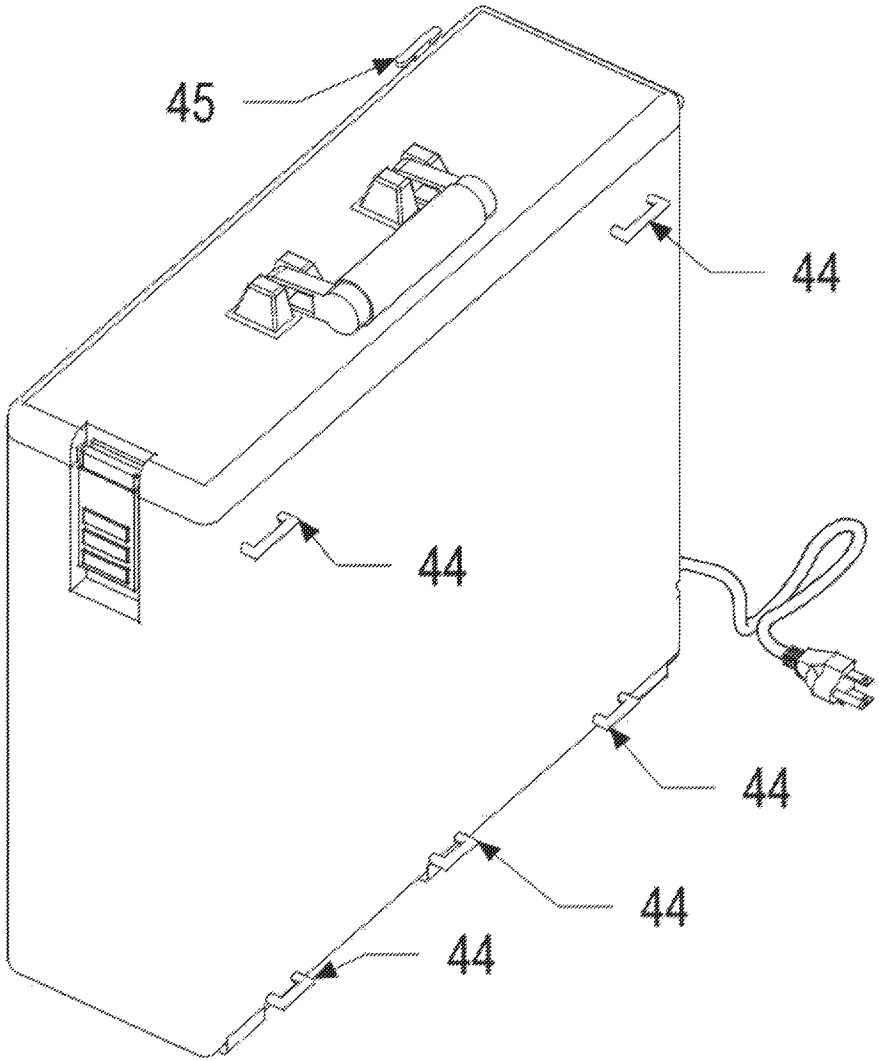

FIGS. 21-28 illustrate embodiments having alternative connectivity. FIGS. 21A, 21B, 22 illustrate an embodiment of the invention in which a sleeve and rod device is used to connect the modules. The sleeves 40 on adjoining boxes alternate in location so they are positioned coaxially when two boxes are positioned side to side. The removable rod 41 is then slid through the coaxial sleeves, rotated and snapped into snap-lock tab 42.

FIGS. 23A, 23B, 23C, and 24 illustrate an embodiment of the invention in which a hook, loop and latch system is used to connect the modules. Hooks 43 insert into corresponding loops 44 on an adjacent module, while latches 45 surround corresponding loops 44 on an adjacent module and when depressed surround the loops and lock them in place.

Figure 25:
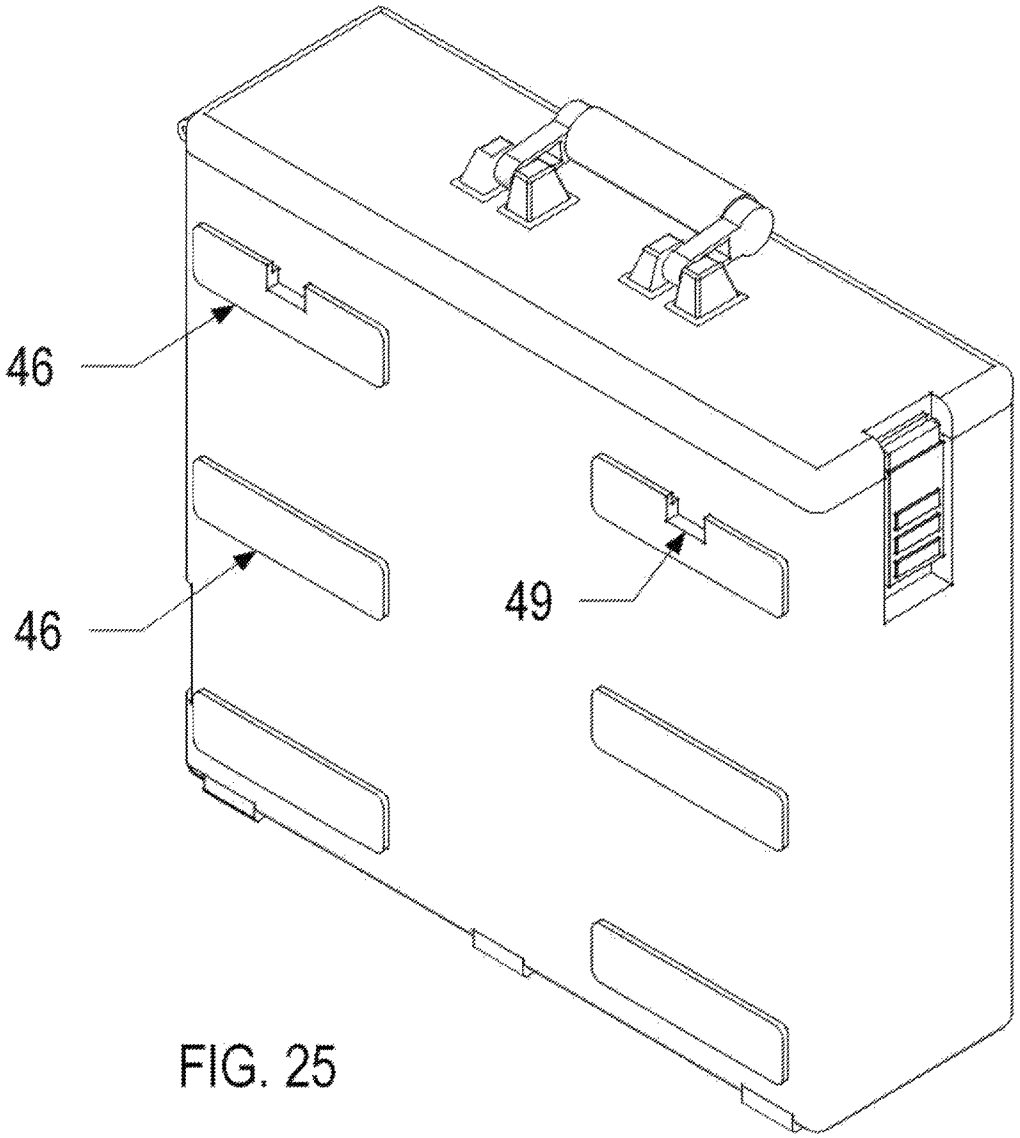
FIGS. 25, 26A, 26B illustrate an embodiment of the invention in which a sliding track and lock system is used to connect the modules, with FIG. 25 being a left three-quarter perspective, FIG. 26A being a right three-quarter perspective, and FIG. 26B being a telescoped view of FIG. 26A near the top front.
Figure 26A:
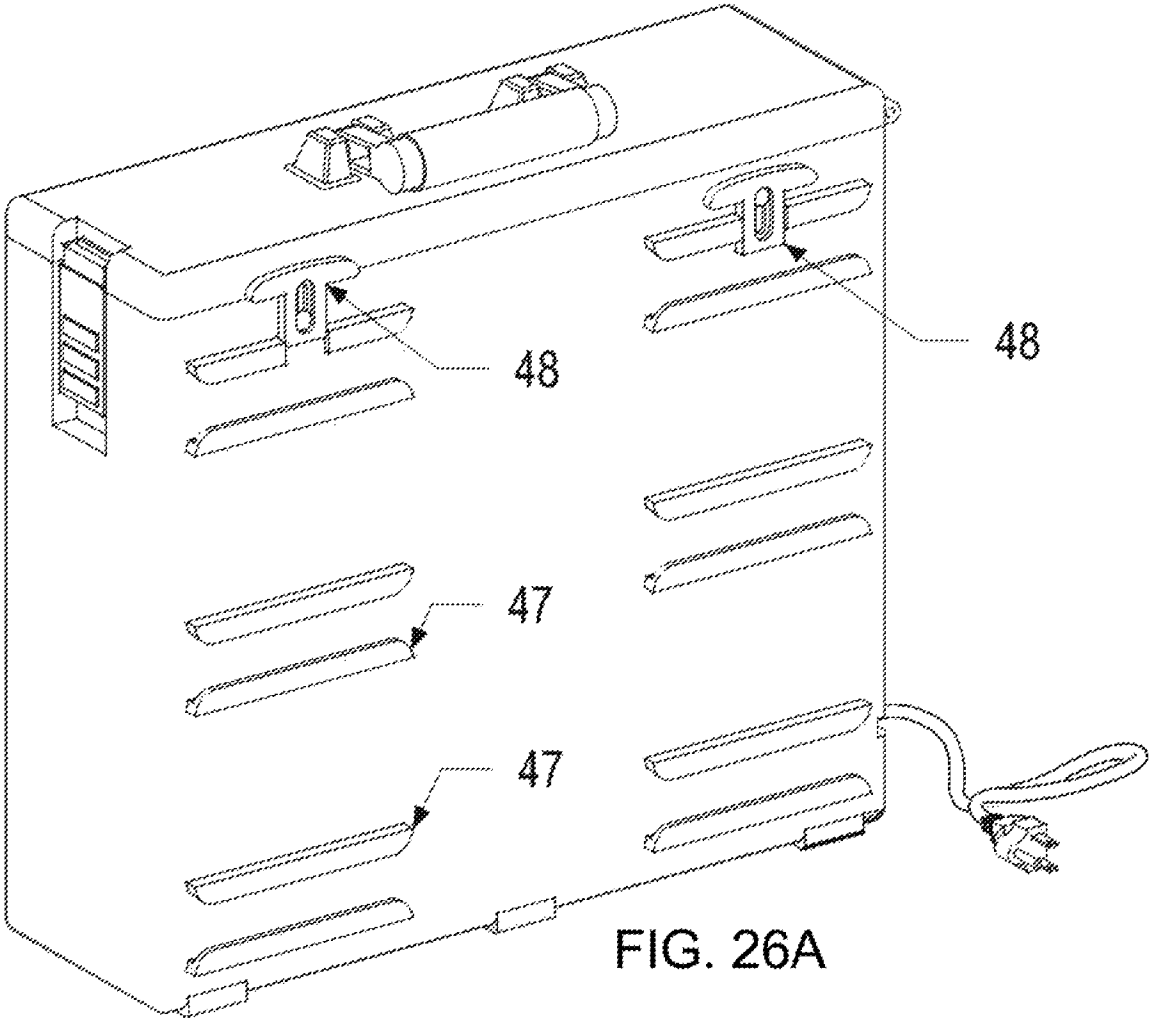
Figure 26B:
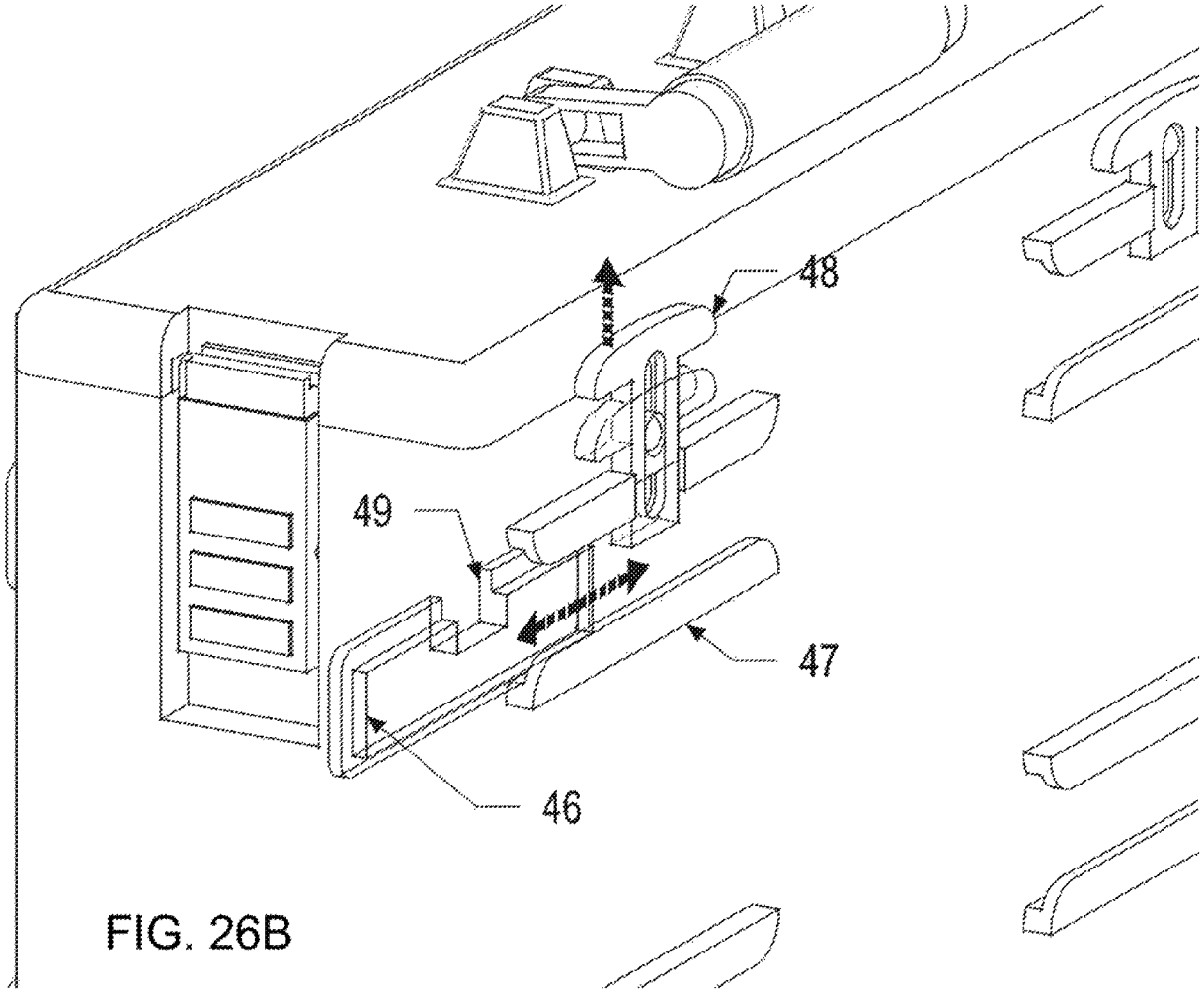

FIGS. 25, 26A, and 26B illustrate an embodiment of the invention in which a sliding track and lock system is used to connect the modules. Complimentary "L" 47 and "T" 46 shaped tracks on adjacent boxes slide into one another. To connect two boxes, place two boxes together with one forward of the other, then slide the forward box backward until cutout 49 lines up with lock slide 48 so that the lock slide can be pushed downward.

Figure 27:
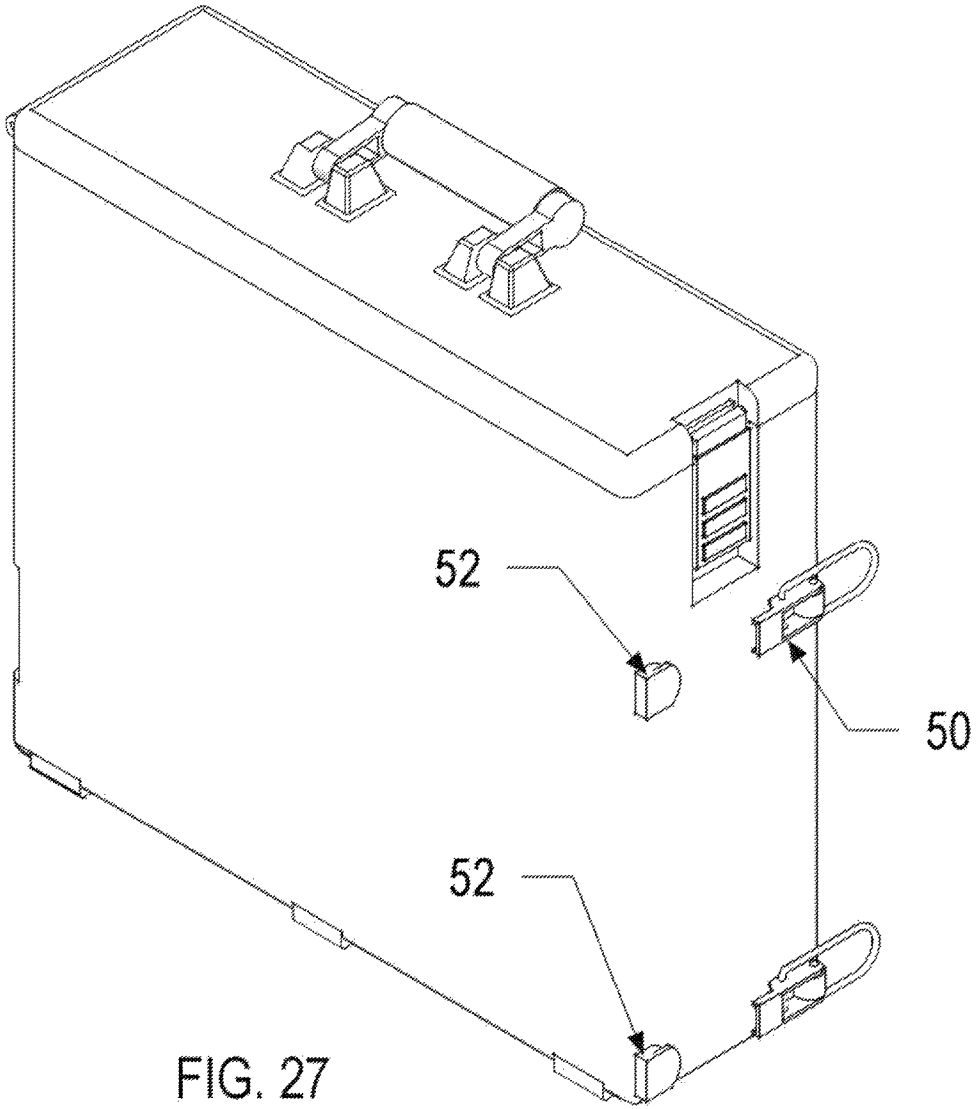
FIGS. 27, 28A, 28B illustrate an embodiment of the invention in which a latch, loop and body tab system is used to connect the modules, with FIG. 27 being a left three-quarter perspective, FIG. 28A being a right three-quarter perspective, and FIG. 28B being a close-up view of FIG. 28A near the top front showing two connected containers.
Figure 28A:
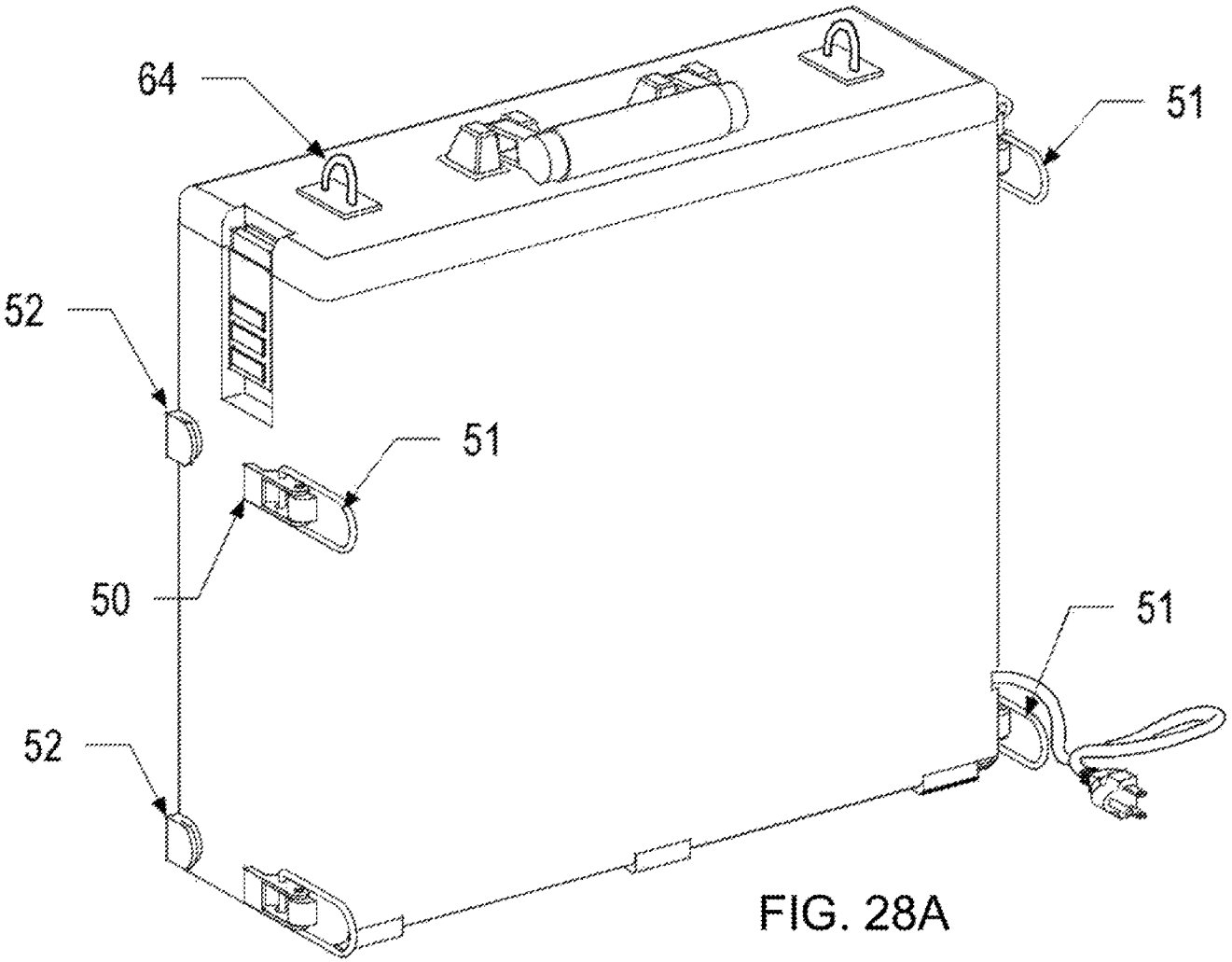
Figure 28B:
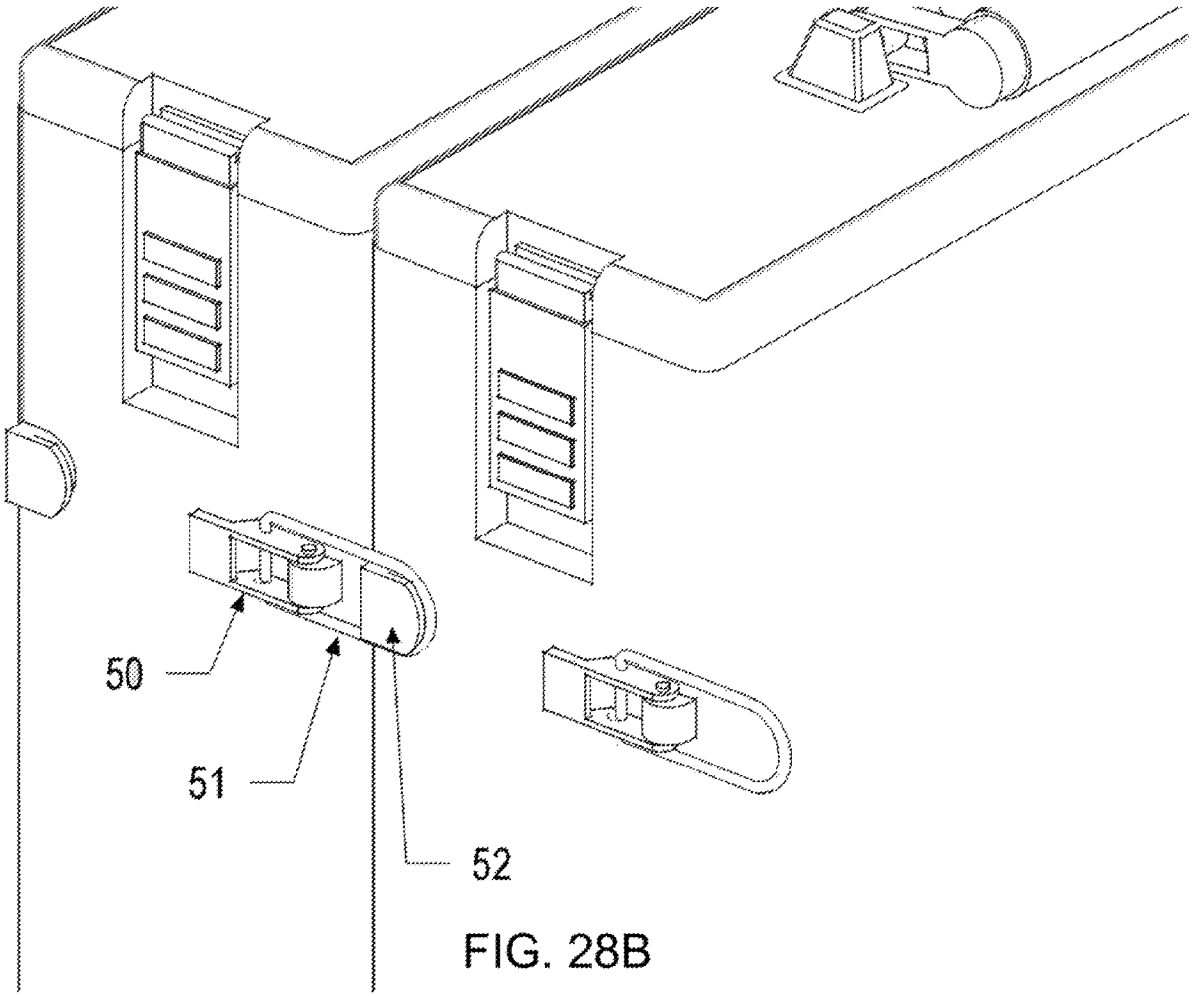

FIGS. 27, 28A, and 28B illustrate an embodiment of the invention in which a latch, loop and body tab system is used to connect the modules. Latch 50 is closed after putting the latch loop 51 around the body-tab 52 of an adjacent container. In FIG. 28, attachment rings 64 built into the lid for attachment of carrying straps are shown.

Figure 29:
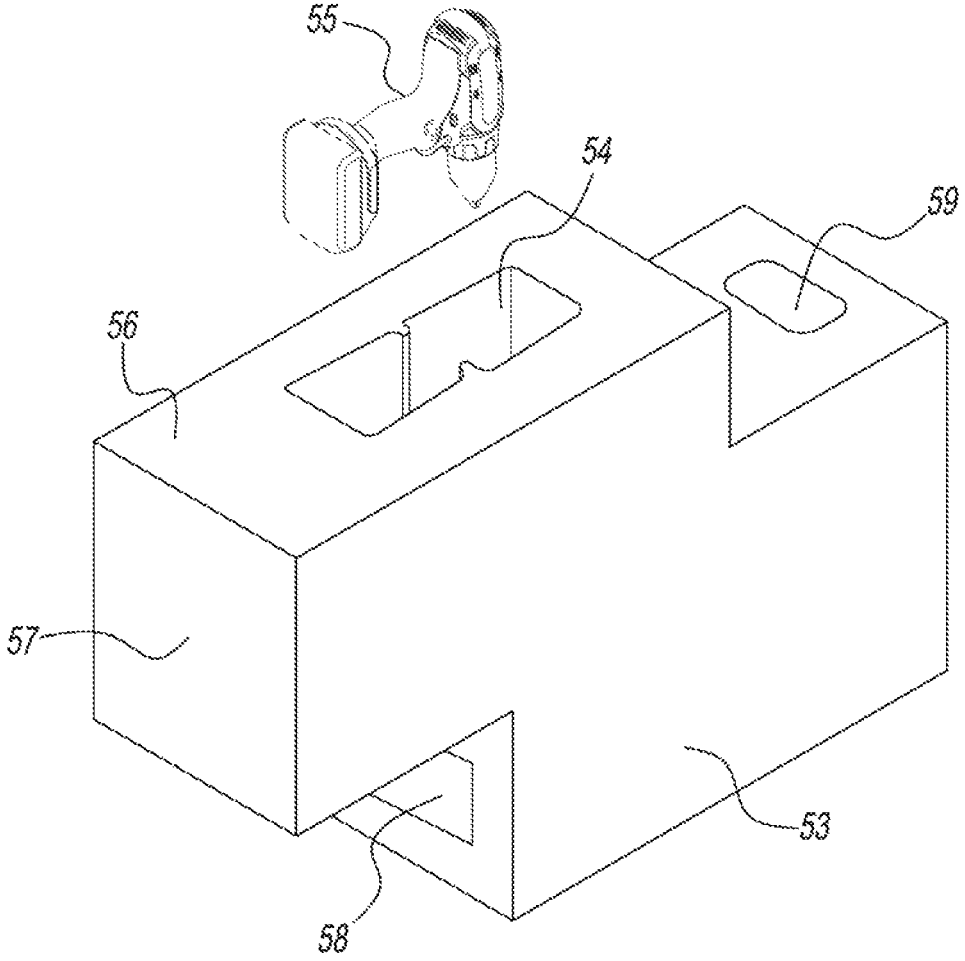
FIG. 29 is a perspective view illustrating an embodiment of a removable/exchangeable shaped box insert.

FIG. 29 is a perspective view illustrating an embodiment of a removable/exchangeable shaped box insert 53. In various exemplary embodiments, the insert is inserted into the interior of the container body 1. In various embodiments, the insert is also capable of interchangeable insertion in, and removal from, the interior of the container body 1.

In various embodiments, the insert defines a cutout 54. The cutout 54 defined by the insert is, in some embodiments, shaped to a predetermined shape. The predetermined shape of the cutout corresponds to the shape of an object 55 intended to be inserted into the cutout. For example, in one particular embodiment, the cutout is shaped to receive a cordless drill 55 having its battery attached thereto. However, in an innumerable number of other particular embodiments, the cutout is shaped to receive any conceivable object. For example, in another particular embodiment, the cutout is designed to receive a set of screwdrivers. Still further, many embodiments omit the insert. The insert is an option included in some embodiments.

In various exemplary embodiments, when the insert is fully inserted into the interior of the container body 1, a top surface 56 of the insert is flush with a bottom of the container lid 2 when the container lid 2 is closed. Similarly, in various embodiments, when the insert is fully inserted into the interior of the container body 1, a front surface 57 of the insert is flush with the interior of a front of the container body 1. In various embodiments, each surface of the insert is similarly flush with a corresponding surface. This minimizes the extent to which the insert may move when inserted. That, in turn, minimizes the extent to which the object in the cutout moves; and, in turn, reduces the extent to which the object in the cutout can be subjected to shocking forces.

In various embodiments that include, for example, accessory storage (see, e.g., FIG. 31), the insert includes a cutout portion 58 to accommodate that accessory storage. Similarly, in various embodiments, the insert includes one or more cutouts 59 of varying descriptions and sizes that create additional accessible space within the interior of the container body 1. In such embodiments, the additional accessible space can be used for any of a multitude of purposes. One example is to accommodate a battery charger.

Figure 30:
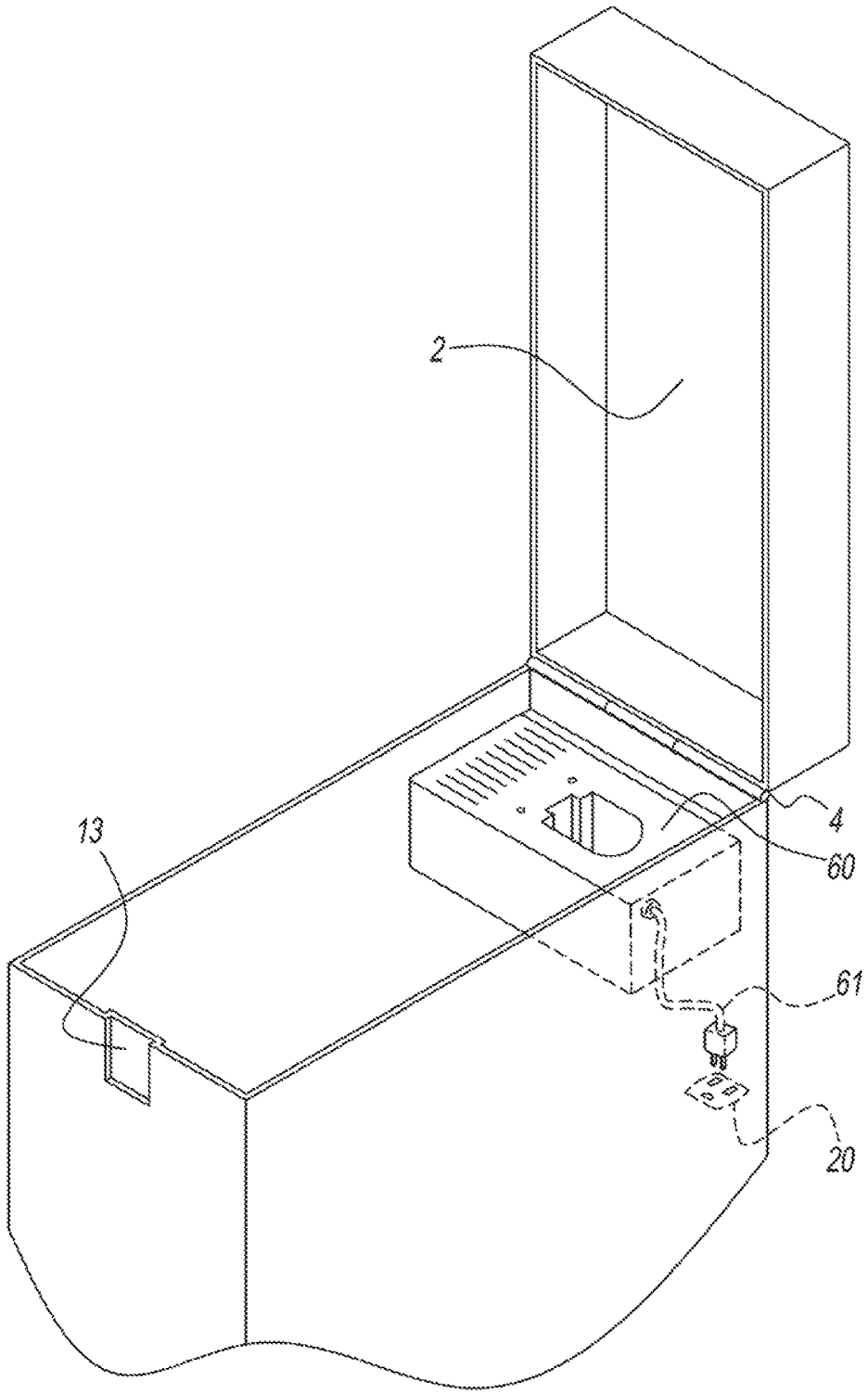
FIG. 30 is a fragmented perspective view illustrating an embodiment of the invention having a battery charger incorporated therein.

FIG. 30 is a fragmented perspective view illustrating an embodiment of the invention having a battery charger 60 incorporated therein. In various embodiments, the location of the battery charger is widely variable within the interior of the container body 1. A power cord 61 of the battery charger plugs into the power supply outlet 20 in the interior of the container. The usefulness of the battery charger is to charge a battery. The battery itself, when connected to the battery charger for the purpose of charging, occupies space. Thus, certain embodiments are designed to accommodate the battery, as well as the battery charger, within the interior of the container body 1. In some embodiments the battery charger 60 may be positioned in the back of the container 1, a few inches from the top. These few inches allow the battery to fit in the container when attached to the charger 60 for charging, while giving the user ready access to the battery and preventing other objects from being placed over or falling onto the battery.

Figure 31:
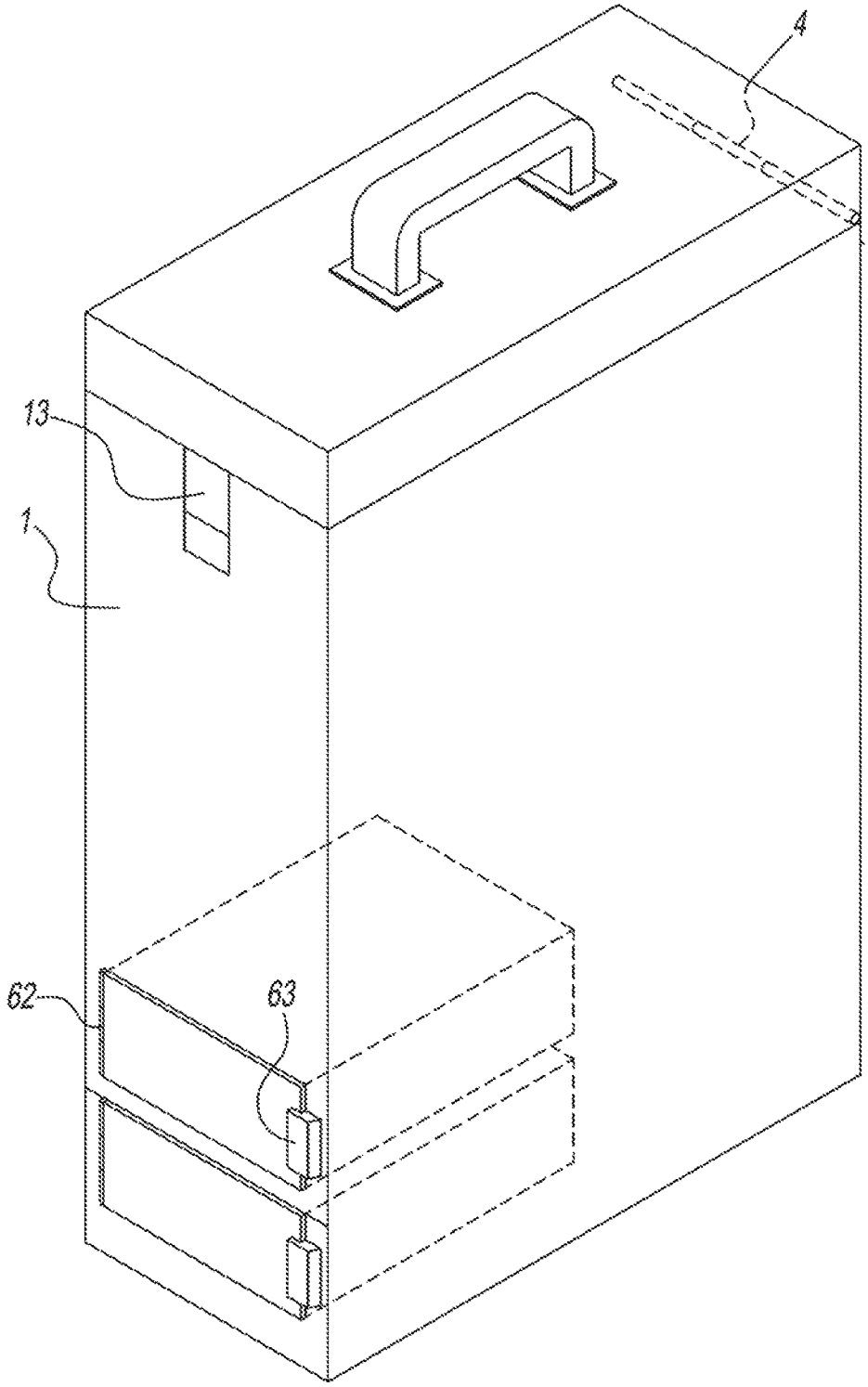
FIG. 31 is a perspective view illustrating an embodiment of the invention including a plurality of accessory storage doors and compartments.

FIG. 31 is a perspective view illustrating an embodiment of the invention including a plurality of accessory storage doors and compartments. Some embodiments include only such one accessory storage assembly. Some embodiments include two; and some embodiments include more than two such accessory storage assemblies. The storage door for an accessory assembly fastens to the container body by some mechanism such that the storage door of the accessory assembly can remain securely closed. Thus, in various embodiments, each accessory storage door is connected to the container body 1 by a hinge 62. In various embodiments, each accessory storage door is connected to the container body 1 by a latch 63. In one such embodiment, each accessory storage door is connected to the container body 1 by a hinge 62 located at a first side of the accessory storage door and by a latch 63 located at a second side of the accessory storage door.

The dimensions of the accessory assembly vary from one embodiment to another. For example, in certain embodiments, the dimensions of the accessory assembly in two directions are six inches by two inches. The accessory assembly is designed to receive objects of a certain size. In one particular example, the accessory assembly is designed to receive drill bits for a drill and/or saw blades for a saw. In another related example, the container body 1 contains at least two accessory assemblies. One of them is designed to receive drill bits; and, another is designed to receive saw blades.

The location of the accessory assembly relative to the edges of the container body also vary from one embodiment to another. For example, in certain embodiments, certain edges of the accessory assembly are positioned one half or one inch from the edges of the container body 1. In various embodiments the accessory assembly or assemblies are positioned below the container lid 2.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items. As used herein, the singular forms "a", "an" and "the" are intended to include the plural forms as well, unless the context clearly indicates otherwise.

The present invention is not limited to the particular embodiments illustrated in the drawings and described above in detail. Those skilled in the art will recognize that other arrangements could be devised, for example using various types of connectors. The present invention encompasses every possible combination of the various features of each embodiment disclosed. One or more of the elements described herein with respect to various embodiments can be implemented in a more separated or integrated manner than explicitly described, or even removed or rendered as inoperable in certain cases, as is useful in accordance with a particular application While the present invention has been described with reference to specific illustrative embodiments, modifications and variations of the present invention may be constructed without departing from the spirit and scope of the present invention as set forth in the following claims.

Although the present invention has been described in detail, those skilled in the art will understand that various changes, substitutions, variations, enhancements, nuances, gradations, lesser forms, alterations, revisions, improvements and knock-offs of the invention disclosed herein may be made without departing from the spirit and scope of the invention in its broadest form.

What is claimed is:

1. A container comprising:

a body having an internal cavity for storing contents, the body including at least one access side of the body having at least one opening therein sufficient in size to accommodate movement of the contents therethrough; and at least one lid configured to releasably close the at least one opening, respectively;

the body further including:

first and second stacking sides having formed therein complimentary-shaped surface features, respectively, configured to be releasably engageable with the corresponding surface features formed in second and first stacking sides, respectively, of other instances of the container, the complimentarily-shaped surface features comprised of a plurality of integral structural male protrusions on the first stacking side to receive a matching plurality of integral structural female receptacles on the second stacking side;

wherein each access side and corresponding lid are configured to permit access therethrough while one or more of the first and second stacking sides are disposed in states of releasable engagement, respectively; and wherein the complimentary-shaped surface features of the first stacking side comprise a first plurality of latches, a first plurality of loops, and a first plurality of body tabs, the complimentary-shaped surface features of the second stacking side include a second plurality of latches, a second plurality of loops, and a second plurality of body tabs, each of the first plurality of body tabs configured to be receiving and releasably engaging a corresponding one of the first plurality of loops of the other instances of the container, each of the second plurality of body tabs configured to be receiving and releasably engaging a corresponding one of the second plurality of loops of the other instances of the container, each of the first plurality of latches configured to be latching a corresponding pair of engaged ones of the first plurality body tabs and the first plurality of loops of the other instances of the container, and each of the second plurality of latches configured to be latching a corresponding pair of engaged ones of the second plurality body tabs and the second plurality of loops of the other instances of the container.

2. The container according to claim 1, wherein the complimentary-shaped surface features of the first stacking side include a plurality of posts and the complimentary shaped surface features of the second stacking side include a plurality of apertures configured to be receiving and releasably engaging the plurality of posts of the other instances of the container.

3. The container according to claim 1, wherein the complimentary shaped surface features of the first stacking side include a plurality of mesas, each of the plurality of mesas having a height in a direction orthogonal to the first stacking side and a width and a length, the height being less than the width and the length, and the complimentary shaped surface features of the second stacking side include a plurality of recesses configured to be receiving and releasably engaging the plurality of mesas of the other instances of the container.

4. The container according to claim 1, wherein the complimentary-shaped surface features comprise a plurality of different types of complimentary-shaped surface features, wherein the corresponding surface features comprises a plurality of different types of surface features and corresponding surface features, and wherein at least two of the plurality of different types of complimentary-shaped surface features are not inverses.

5. The container according to claim 1, wherein the at least one lid comprises an integrated latch flush fitting in a recess on a first non-stacking side to secure the lid closed when the at least one lid is latched closed.

6. A container-assembly comprising:

at least first and second containers, each container including:

a body having an internal cavity for storing contents, the body including at least one access side of the body having at least one opening therein sufficient in size to accommodate movement of the contents therethrough; and at least one lid configured to releasably close the at least one opening, respectively;

the body of each container further including:

first and second stacking sides having formed therein complimentary-shaped surface features, respectively, configured to be releasably engageable with the corresponding surface features formed in second and first stacking sides, respectively, of other instances of the container;

wherein, for each container, each access side and corresponding lid are configured to permit access therethrough while one or more of the first and second stacking sides are disposed in states of releasable engagement, respectively;

wherein the complimentary-shaped surface features formed in the first and second stacking sides of the first container are releasably engaged with the corresponding surface features formed in second and first stacking sides of the second container, respectively, the corresponding surface features including an integrated structural protrusion for engaging with an integrated structural recess; and a carrier apparatus and a first bar sandwiched between the at least first and second containers, the first bar being removable, the first bar comprising:

a plurality of locations of container connection, each of the plurality of locations of container connection being sandwiched between two of the at least first and second containers, and each of the plurality of locations of container connection being securely connected to each of two of the at least first and second containers; and a plurality of locations of carrier connection, the plurality of locations of carrier connection being different locations than the plurality of locations of container connection, the carrier apparatus being securely connected to the bar at one or more of the plurality of locations of carrier connection.

7. The container-assembly according to claim 6, wherein the at least one lid comprises an integrated latch flush fitting in a recess on a first non-stacking side to secure the lid closed when the at least one lid is latched closed.

8. A hand-truck assembly comprising:

a container-assembly comprising:

at least first and second containers, each container including:

a body having an internal cavity, the body including an access side of the body having an opening therein;

the body of each container further including:

first and second stacking sides having formed therein complimentary-shaped surface features configured to be releasably engageable with the corresponding surface features formed in second and first stacking sides, respectively, of other instances of the container;

wherein, for each container, each access side is configured to permit access therethrough while one or more of the first and second stacking sides are disposed in states of releasable engagement, respectively;

wherein the complimentary-shaped surface features formed in the first stacking side of the first container are releasably engaged with the corresponding surface features formed in the first stacking side of the second container, respectively; and a wheel assembly including a first frame having apertures corresponding to the apertures on the second stacking sides of each of the containers;

wherein the apertures of the first frame are releasably engaged with the complimentary-shaped surface features on the first stacking side of the first container, respectively; and a handle assembly including a second frame having surface features corresponding to the surface features on the second stacking side of the second container;

wherein the surface features of the second frame are releasably engaged with the surface features on the second stacking side of the second container, respectively.

9. A container comprising:

a body having an internal cavity, the body including at least one access side of the body having at least one opening therein;

the body further including:

first and second stacking sides having formed therein complimentary-shaped surface features, respectively, configured to be releasably engageable with the corresponding surface features formed in second and first stacking sides, respectively, of other instances of the container;

wherein the at least one access side is configured to permit access therethrough while one or more of the first and second stacking sides are disposed in states of releasable engagement, respectively, wherein the complimentary-shaped surface features, respectively, configured to be releasably engageable with the corresponding surface features comprises a plurality of different types of complimentary-shaped surface features and corresponding surface features, wherein a first type of the plurality of different types of complimentary-shaped surface features and corresponding surface features has a dimension in a depth direction and a dimension in a width direction, and the dimension in the depth direction of the first type of the plurality of types of complimentary-shaped surface features and corresponding surface features is larger than the dimension in the width direction of the first type of the plurality of types of complimentary-shaped surface features and corresponding surface features, and a second type of the plurality of different types of complimentary-shaped surface features and corresponding surface features has a dimension in the depth direction and a dimension in the width direction, and the dimension in the depth direction of the second type of the plurality of types of complimentary-shaped surface features and corresponding surface features is smaller than the dimension in the width direction of the second type of the plurality of types of complimentary-shaped surface features and corresponding surface features.

10. A container-assembly comprising:

at least first and second containers, each container including:

a body having an internal cavity for storing contents, the body including at least one access side of the body having at least one opening therein sufficient in size to accommodate movement of the contents therethrough; and at least one lid configured to releasably close the at least one opening, respectively;

the body of each container further including:

first and second stacking sides having formed therein complimentary-shaped surface features, respectively, configured to be releasably engageable with the corresponding surface features formed in second and first stacking sides, respectively, of other instances of the container;

wherein, for each container, each of the at least one access side and each corresponding lid are configured to permit access therethrough while one or more of the first and second stacking sides are disposed in states of releasable engagement, respectively;

wherein surface features formed in the first and second stacking sides of the first container are releasably engaged with the corresponding surface features formed in second and first stacking sides of the second container, respectively, further comprising a carrier apparatus comprising a flat insert sandwiched between the at least first and second containers, the flat insert being removable, the flat insert comprising:

a plurality of locations of container connection, each of the plurality of locations of container connection being sandwiched between two of the at least first and second containers, and each of the plurality of locations of container connection being securely connected to each of two of the at least first and second containers;

wherein the flat insert comprises a plurality of anchoring apertures, each of the plurality of anchoring apertures being at a one of the plurality of locations of container connection, and each of the plurality of anchoring apertures receiving a protrusion to achieve the secure connection to each of the two of the at least first and second containers, each protrusion being one of the complementary-shaped surface features, and the plurality of anchoring apertures being of a fewer number than the complimentary-shaped surface features of each of the first and second containers.

* * * * *